US010485317B2

(12) United States Patent
Debenedictis et al.

(10) Patent No.: US 10,485,317 B2
(45) Date of Patent: Nov. 26, 2019

(54) HAIR STYLING DEVICE

(71) Applicant: HD3 LIMITED, Birmingham (GB)

(72) Inventors: Alfredo Debenedictis, Crumlin (GB); Mark Christopher Hughes, Clent (GB); Janusz Lucien Holland, Birmingham (GB)

(73) Assignee: HD3 LIMITED, Birmingham (GB)

( * ) Notice: Subject to any disclaimer, the term of this patent is extended or adjusted under 35 U.S.C. 154(b) by 441 days.

(21) Appl. No.: 15/123,811

(22) PCT Filed: Mar. 5, 2015

(86) PCT No.: PCT/GB2015/050638
§ 371 (c)(1),
(2) Date: Sep. 6, 2016

(87) PCT Pub. No.: WO2015/132594
PCT Pub. Date: Sep. 11, 2015

(65) Prior Publication Data

US 2017/0013928 A1 Jan. 19, 2017

(30) Foreign Application Priority Data

Mar. 7, 2014 (GB) ..... 1404089.3
Jul. 18, 2014 (GB) ..... 1412817.7

(51) Int. Cl.
*A45D 6/02* (2006.01)
*A45D 2/00* (2006.01)
(Continued)

(52) U.S. Cl.
CPC ..... *A45D 2/001* (2013.01); *A45D 2/36* (2013.01); *A45D 2/367* (2013.01); *A45D 6/02* (2013.01); *A45D 7/02* (2013.01)

(58) Field of Classification Search
CPC ..... A45D 2/001; A45D 2/36; A45D 2/367; A45D 6/02; A45D 7/02
See application file for complete search history.

(56) References Cited

U.S. PATENT DOCUMENTS 1,609,810 A 12/1926 Gates
1,636,967 A 7/1927 Perry
(Continued)

FOREIGN PATENT DOCUMENTS

DE 172581 C 2/1905
EP 1417906 A1 5/2004
(Continued)

OTHER PUBLICATIONS

"Unpublished U.S. Appl. No. 15/115,686, filed Jul. 31, 2016".
(Continued)

*Primary Examiner* — Nicholas D Lucchesi
(74) *Attorney, Agent, or Firm* — Hultquist, PLLC; Steven J. Hultquist

(57) ABSTRACT

This invention relates to a hair styling device (10). The device has a body (12) defining a chamber (16) adapted to accommodate a length of hair (24), the chamber having an opening (22) through which the length of hair may pass into the chamber. A rotatable element (26) is adapted to engage the length of hair adjacent to the opening and to wind the length of hair around a protrusion within the chamber. A first hair-straightening panel (44) and a second hair-straightening panel (46) are provided, the first hair-straightening panel and the second hair-straightening panel facing one another and defining a passage (50) through which the length of hair passes as it leaves the chamber, the first hair-straightening panel and the second hair-straightening panel being movable relative to one another.

17 Claims, 13 Drawing Sheets

(51) Int. Cl.
*A45D 2/36* (2006.01)
*A45D 7/02* (2006.01)

(56) References Cited

U.S. PATENT DOCUMENTS

| | | | | |
|---|---|---|---|---|
| 1,806,711 | A | 5/1931 | Salzman | |
| 1,827,785 | A | 10/1931 | Frederics | |
| 1,831,487 | A | 11/1931 | Elam | |
| 1,877,776 | A | 9/1932 | Pezzella | |
| 1,884,305 | A | 10/1932 | Shelton | |
| 1,894,624 | A | 1/1933 | Marcel | |
| 1,895,653 | A | 1/1933 | Fisher | |
| 1,981,362 | A | 11/1934 | Joyce | |
| 2,595,844 | A | 5/1952 | Graham | |
| 2,791,225 | A | 5/1957 | Simmons | |
| 2,867,223 | A | 1/1959 | Anzalone | |
| 2,906,272 | A | 9/1959 | Heidel | |
| 2,935,070 | A | 5/1960 | Auz | |
| 3,213,859 | A | 10/1965 | Mizell et al. | |
| 3,213,860 | A * | 10/1965 | Tewksbury | A45D 6/06 132/228 |
| 3,223,093 | A | 12/1965 | Winters | |
| 3,255,765 | A | 6/1966 | Sturdivant | |
| 3,786,819 | A | 1/1974 | Cantrell | |
| 3,805,810 | A | 4/1974 | Savala | |
| 3,835,292 | A | 9/1974 | Walter et al. | |
| 3,968,805 | A | 7/1976 | Sobeck, Jr. | |
| 4,148,330 | A | 4/1979 | Gnaga | |
| 4,177,824 | A | 12/1979 | Gnaga | |
| 4,222,398 | A | 9/1980 | Fromman | |
| 4,829,156 | A | 5/1989 | Thompson | |
| 4,884,583 | A | 12/1989 | Long, Jr. | |
| 5,119,847 | A | 6/1992 | Powell et al. | |
| 5,472,003 | A | 12/1995 | Frame et al. | |
| 5,584,309 | A | 12/1996 | De Beneditis et al. | |
| 5,771,906 | A | 6/1998 | De Benedictis | |
| 5,813,419 | A | 9/1998 | Brams | |
| 6,637,441 | B2 * | 10/2003 | Kennedy | A45D 2/00 132/212 |
| 6,647,989 | B1 | 11/2003 | De Benedictis | |
| 6,962,159 | B1 | 11/2005 | Adam | |
| 7,121,285 | B2 | 10/2006 | Kraus | |
| 7,198,049 | B2 | 4/2007 | Elmer et al. | |
| 7,305,995 | B2 | 12/2007 | Tojo et al. | |
| 7,487,783 | B2 | 2/2009 | Saito et al. | |
| 7,500,487 | B2 | 3/2009 | Kobayashi et al. | |
| 7,513,259 | B2 | 4/2009 | Kimata et al. | |
| 7,770,586 | B2 | 8/2010 | Tojo et al. | |
| 7,789,093 | B2 | 9/2010 | Tojo et al. | |
| 8,132,575 | B2 | 3/2012 | Tojo et al. | |
| 8,256,438 | B2 | 9/2012 | Tojo et al. | |
| 8,607,804 | B2 | 12/2013 | De Benedictis | |
| 8,651,118 | B2 | 2/2014 | De Benedictis et al. | |
| 8,733,374 | B2 | 5/2014 | De Benedictis et al. | |
| 8,869,808 | B2 | 10/2014 | De Benedictis | |
| 9,027,570 | B2 | 5/2015 | De Benedictis et al. | |
| 9,138,039 | B2 | 9/2015 | De Benedictis et al. | |
| 9,345,302 | B2 * | 5/2016 | Chung | A45D 2/367 |
| 9,629,434 | B2 * | 4/2017 | DeBenedictis | A45D 2/02 |
| 9,854,891 | B2 * | 1/2018 | De Benedictis | A45D 2/02 |
| 2004/0231689 | A1 | 11/2004 | Kobayashi et al. | |
| 2004/0231690 | A1 | 11/2004 | De Benedictis | |
| 2004/0237991 | A1 | 12/2004 | Glucksman et al. | |
| 2005/0241663 | A1 | 11/2005 | Getahun | |
| 2005/0268933 | A1 | 12/2005 | Kimata et al. | |
| 2005/0284493 | A1 | 12/2005 | Allen | |
| 2006/0124148 | A1 | 6/2006 | Tojo et al. | |
| 2006/0157078 | A1 | 7/2006 | Tojo et al. | |
| 2007/0017541 | A1 | 1/2007 | Wilmore | |
| 2007/0065489 | A1 | 3/2007 | Tojo et al. | |
| 2007/0068547 | A1 | 3/2007 | Gurth et al. | |
| 2007/0084479 | A1 | 4/2007 | Ryan-Jakimas | |
| 2008/0035167 | A1 | 2/2008 | Chan | |
| 2008/0236610 | A1 | 10/2008 | Bartels | |
| 2008/0302381 | A1 | 12/2008 | Tojo et al. | |
| 2009/0056738 | A1 | 3/2009 | Tojo et al. | |
| 2010/0083978 | A1 | 4/2010 | Hottenrott et al. | |
| 2010/0170883 | A1 | 7/2010 | Legrain et al. | |
| 2010/0263684 | A1 | 10/2010 | De Benedictis | |
| 2011/0220141 | A1 | 9/2011 | Chan | |
| 2012/0186601 | A1 | 7/2012 | Ungar et al. | |
| 2013/0025621 | A1 | 1/2013 | De Benedictis | |
| 2013/0125919 | A1 | 5/2013 | De Benedictis et al. | |
| 2014/0076351 | A1 | 3/2014 | De Benedictis et al. | |
| 2014/0216494 | A1 | 8/2014 | De Benedictis et al. | |
| 2015/0000689 | A1 | 1/2015 | De Benedictis | |
| 2015/0128987 | A1 | 5/2015 | De Benedictis et al. | |
| 2015/0201727 | A1 | 7/2015 | De Benedictis et al. | |
| 2015/0216281 | A1 | 8/2015 | De Benedictis et al. | |
| 2016/0255937 | A1 | 9/2016 | De Benedictis et al. | |

FOREIGN PATENT DOCUMENTS

| | | | |
|---|---|---|---|
| EP | 2392222 | A1 | 12/2011 |
| FR | 641097 | A | 7/1928 |
| FR | 38041 | A | 3/1931 |
| FR | 2310105 | A1 | 11/1976 |
| GB | 303043 | A | 12/1928 |
| GB | 1036583 | A | 7/1966 |
| GB | 1157814 | A | 7/1969 |
| GB | 302952 | A | 12/1978 |
| GB | 2413492 | A | 11/2005 |
| JP | S60140502 | U | 9/1985 |
| JP | 61-10102 | U | 1/1986 |
| JP | S6278801 | U | 5/1987 |
| JP | S633808 | A | 1/1988 |
| JP | 2002520076 | A | 7/2002 |
| JP | 2005324073 | A | 11/2005 |
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

"Note: As to any co-pending U.S. applications cited herein, Applicant will provide at the examiner's request any documents desired by the examiner from the USPTO file history of any such co-pending applications."

* cited by examiner

HAIR STYLING DEVICE

CROSS-REFERENCE TO RELATED APPLICATIONS

This application is a U.S. national phase under the provisions of 35 U.S.C. § 371 of International Patent Application No. PCT/GB2015/050638 filed Mar. 5, 2015, which in turn claims priority of United Kingdom Patent Application No. 1404089.3 filed Mar. 7, 2014 and priority of United Kingdom Patent Application No. 1412817.7 filed Jul. 18, 2014. The disclosures of such international patent application and United Kingdom priority patent applications are hereby incorporated herein by reference in their respective entireties, for all purposes.

FIELD OF THE INVENTION

This invention relates to a hair styling device.

For brevity, in the present application reference is made to the styling of a female's hair, but the invention is not limited thereby.

BACKGROUND TO THE INVENTION

Hair styling devices are described in WO2009/077747, WO2012/080751, WO2013/186547 and PCT/GB2014/051386. The described hair styling devices all have a rotatable element which captures a length of hair to be styled and winds the length of hair around a protrusion in the form of an elongate member. The preferred embodiments utilise a chamber surrounding the elongate member, the chamber perhaps being heated by way of heat applied to the walls of the chamber and/or to the elongate member. Instead of (or in addition to) the application of heat, a hair treatment product may be applied to the hair within the chamber. The hair within the chamber becomes styled by the application of heat and/or by the application of the treatment product whilst it is located within the chamber.

The present invention shares many of the features of the preferred embodiments of the hair styling devices described in WO2009/077747, WO2012/080751, WO2013/186547 and PCT/GB2014/051386, and it is believed that the hair styling devices described in those documents represent the closest prior art to the present invention.

The identified prior art documents all impart curls to the user's hair. The inventors have realised that a modified device can be used (alternatively or additionally) to create other styles in the user's hair.

SUMMARY OF THE INVENTION

According to a first aspect of the present invention, there is provided a hair styling device having:

a body defining a chamber adapted to accommodate a length of hair, the chamber having an opening through which the length of hair may pass into the chamber;

a rotatable element adapted to engage the length of hair adjacent to the opening;

a protrusion around which, in use, the length of hair is wound by the rotatable element; and a first hair-straightening panel and a second hair-straightening panel, the first hair-straightening panel and the second hair-straightening panel facing one another and being movable relative to one another.

The present invention shares the features of the identified prior art documents in having an opening through which the length of hair to be styled is introduced into the chamber and a rotatable element which rotates adjacent to the opening. In use, in common with the identified prior art documents, rotation of the rotatable element winds the length of hair around the protrusion. Also in common with the prior art, in those embodiments in which the user cannot (or does not) insert the length of hair directly into the chamber the rotatable element may also drive the length of hair through the opening and into the chamber.

The present invention also shares the feature of a chamber for containing the wound length of hair. As with the prior art documents, in preferred embodiments of the present invention the chamber is almost fully enclosed, i.e. it is surrounded by a substantially continuous wall. This is preferred so as to maximise the control over the temperature within the chamber, and also to maximise the area of the chamber wall which can be heated. It will be appreciated, however, that in less preferred embodiments the outer wall of the chamber may not be heated and in such embodiments the chamber can be relatively open, i.e. surrounded by a perforated wall or cage which serves simply to accommodate and retain the length of hair.

The present invention differs from the prior art documents in providing first and second cooperating hair-straightening panels between which the hair can pass upon leaving the chamber. The prior art documents seek to remove the wound length of hair from the chamber with the minimum of interaction with the wound length of hair, and the minimum disruption of the formed curl, it being recognised that some of the formed curl will be lost if the hair is forced to uncurl, or is otherwise placed under tension, as it is removed from the chamber. The present invention seeks to take advantage of the fact that the hair remains susceptible to styling as it leaves the chamber, the hair being (further) styled (and in particular at least partially straightened) as it passes between the first and second hair-straightening panels.

Conventional hair straighteners comprise a pair of flat hair-straightening panels which can be heated to a very high temperature. A length of hair is inserted between the panels, the panels are pressed towards one another substantially to clamp the length of hair therebetween, and the length of hair is pulled through the passage between the panels. The hair is softened by the heat of the panels and since it is held flat between the panels it is caused to straighten. The hair cools as it leaves the panels and retains its straightened form.

The known hair straighteners suffer a number of disadvantages. Firstly, the temperature to which the panels are heated is high enough to cause damage to the user's skin and significant pain to the user if a panel is touched. Special care needs to be taken not to touch inadvertently one or other of the panels during use. Also, special provisions must be taken to avoid damage to worktops or other surfaces upon which the hair straighteners are rested whilst the panels heat up and cool down.

Secondly, the extreme heat which is applied to the user's hair, and also the pressure which is applied to the hair by way of the panels, can both damage the user's hair, especially if hair straighteners are used frequently. The extreme heat and pressure are, however, required to achieve the desired hair straightening and so cannot be avoided without reducing the effectiveness of the hair straighteners.

In the present invention, the length of hair is drawn into the chamber and can be retained within the chamber before passing between the panels. One or more heating elements can be provided for the chamber so that heat can be applied to the length of hair therein, enabling the application of heat for a relatively long period of time. Increasing the time for which the length of hair is heated enables a reduction in the maximum temperature required, i.e. the length of hair can reach the required temperature for styling more slowly. Reducing the maximum temperature reduces the likelihood of damage to the user's hair, reduces the likelihood of pain and damage to the user if a heated surface is inadvertently touched, and reduces the likelihood of damage to a worktop or the like.

In addition, because the hair is heated before it passes between the panels, the length of time for which the hair remains between the panels is less critical to the styling operation. For example, to effectively straighten hair that is naturally tightly curled it is necessary to retain the hair clamped tightly between the panels of conventional hair straighteners for a relatively long time, which is achieved by moving the length of hair very slowly through the passage between the panels. With the present invention on the other hand the period of time for which the hair is between the panels is less critical because the hair is already heated to (or close to) the styling temperature before it leaves the chamber. A user of the present invention can therefore move the length of hair relatively quickly between the panels and yet achieve the same straightening effect, making the straightening operation easier and more convenient for the user.

Enabling the user to move the hair relatively quickly between the panels has the additional benefit of reducing the likelihood of damage to the hair, particularly for frequent users of hair straighteners. Thus, it is understood that retaining the hair for relatively long periods, tightly pressed between the very hot panels of conventional hair straighteners, is likely to damage the user's hair.

There is also provided a method of styling hair comprising the following steps:

{i} providing a hair styling device having:

a body defining a chamber, the chamber having an opening;

a rotatable element located adjacent to the opening;

a protrusion within the chamber; and a first hair-straightening panel and a second hair-straightening panel, the first hair-straightening panel and the second hair-straightening panel facing one another and being movable relative to one another;

{ii} collecting a length of hair to be styled;

{iii} positioning the length of hair adjacent to the opening and within the path of movement of the rotatable element;

{iv} rotating the rotatable element, the rotatable element engaging the length of hair and winding the length of hair around the protrusion;

{v} removing the length of hair from the chamber through a passage between the hair-straightening panels, the length of hair being styled as it passes between the panels.

The size of the passage between the panels is preferably adjustable, so that the method can include the additional step of selecting a chosen spacing between the first and second hair straightening panels before step {v} is undertaken.

Ideally, there are multiple heating elements. The provision of multiple heating elements allows different temperatures to be applied at different locations of the device. Preferably the chamber is substantially closed and there is at least one heating element for the chamber, and at least one further heating element for each of the panels. It can be arranged that the heating element(s) which impart the maximum temperature to the length of hair are located within the chamber, the temperature of the heating elements for the panels being lower so that the likelihood of pain or damage caused by inadvertent contact of the user or with the surface of a worktop is much reduced or avoided.

The inventors therefore use a rotatable element, protrusion and chamber similar to those of the known devices as a convenient and reliable means of capturing a length of hair and retaining it in a suitable location before passing the length of hair between the hair-straightening panels. The length of hair can be heated (or otherwise treated, as applicable) whilst it is in the chamber as well as (or instead of) whilst it passes between the panels.

In the identified prior art documents the chamber is primarily a styling chamber within which the length of hair is formed into the desired curls; in the present invention the chamber can be used to prepare the length of hair for subsequent passage between the panels, e.g. as a (pre-) heating chamber. It is nevertheless recognised that if the length of hair is heated within the chamber it will be at least partially styled into curls within the chamber, which curls can subsequently be removed as the length of hair passes between the panels. In such embodiments the length of hair undergoes two styling procedures, the first (curling) procedure within the chamber and the second (straightening) procedure as it passes between the panels.

The dimensions of the first and second hair-straightening panels can be chosen by the manufacturer, bearing in mind that larger panels will typically enable more complete straightening of the length of hair (and perhaps the styling of a larger section of hair) but will also increase the size and weight of the device. Because of the possible pre-heating of the length of hair within the chamber, it may be possible to provide panels significantly smaller (i.e. narrower) than the panels of conventional hair straighteners, whilst achieving a similar degree of straightening.

If desired, the curls can be completely removed from a length of hair as it passes between the panels. At the other extreme the panels may be unheated and the length of hair passed quickly therebetween, perhaps under little or no pressure, so that the minimum amount of curl is removed. Whilst in the latter embodiments the length of hair can be very curly when it leaves the device, it is nevertheless appropriate to refer to the panels as hair-straightening panels as they will have some (chosen) straightening effect upon the length of hair. The device may also be operated between these extremes, with the temperature of the panels (and/or the chamber), and/or the duration for which the length of hair is retained within the chamber and subsequently between the panels, and/or the pressure applied by the panels, determining the degree to which the curls are removed by the panels. The degree of straightening can therefore be varied, from full straightening to partial straightening (i.e. the removal of some but not all of an existing curl—often called "smoothing" or "taming").

In its simplest embodiments the hair styling device of the present invention is designed solely for straightening a user's hair (with a user-selectable degree of straightening, as desired). As above indicated, however, because the length of hair is initially wound around the protrusion it acquires a curl before passing between the panels. Preferred embodiments of the present invention can allow the user to pass the length of hair between the panels, or to bypass the panels, as desired. Clearly, if the hair-straightening panels are bypassed they will have no straightening effect upon the length of hair. The user can therefore either straighten her hair or can impart curls to her hair with a single device, depending upon the chosen mode of operation.

Such preferred embodiments of the present invention utilise a protrusion with a free end, and with an opening adjacent to the free end (similar to the elongate member and secondary opening described in WO2012/080571, for example). If the hair-straightening panels of such an embodiment are bypassed, the curled length of hair can be slid out of the chamber around the free end of the protrusion so as to maintain the maximum curl.

In the pending international patent application PCT/GB2014/051386 by the same inventors, heating elements are located in desired locations throughout the housing, and act to heat the length of hair before it enters the chamber as well as whilst it is retained within the chamber. Heating elements can similarly be located throughout the present device, including in the first and/or second panels, to determine the temperature regime for the length of hair in different parts of the device.

Preferably, the first and second hair-straightening panels are substantially planar and so replicate the flat panels of conventional hair straighteners. Alternatively, the panels may be shaped to impart shaping into the length of hair. For example, the panels may have a wave pattern, the length of hair passing across the waves as it moves through the passage.

Desirably, the form of the first panel and the second panel are complementary so that the passage is substantially uniformly-sized across much or all of the panels (whether the panels are planar or not).

The panels may also act to spread the length of hair across their hair-engagement surfaces, i.e. to increase the area of the panels which contact the length of hair. It will be recognised that winding of the length of hair around the protrusion will typically cause the length of hair to bunch together somewhat into the form of a length of rope. It is, however, desired to flatten out the length of hair into a more ribbon-like shape as it passes between the panels, so as to maximise the likelihood that all of the hair experiences the same temperature regime between the panels, and thereby undergoes substantially the same straightening procedure. One or both of the panels may carry rollers, combs or other components which act to spread out the length of hair as it passes to (or through) the passage between the panels.

Preferably therefore, the invention according to the first aspect incorporates a distributing component to distribute, spread or move the length of hair across the panels. In preferred embodiments the distributing component is in the form of a helical element. The distributing component can preferably perform two functions. Firstly, it can help to ensure that the length of hair is spread across the panels.

Secondly, it can be used to move the length of hair across the panels. In the case of a helical element the length of hair can be moved across the panels by aligning the longitudinal axis of the helical element across the panels and rotating the helical element about the longitudinal axis.

Preferably, the peripheral edge of the distributing component is deformable. Thus, if the user's hair contains knots it is desirable that the user can nevertheless pull the device away from her head past the distributing component. Alternatively, the distributing component may be non-deformable, but movable out of the path of the length of hair, whereby to permit the removal of a knotted length of hair. Desirably, the distributing component is a metallic coil similar to a spring with a pitch of several millimeters.

It will be understood that the pressure which is applied to the length of hair as it passes between the panels is less important with the present invention than with the prior art hair straighteners. Specifically, with the present invention it can be arranged that the length of hair is put under little or no pressure as it passes between the panels, i.e. it is simply drawn through a controlled gap between the panels. The mere engagement of the hair with one or other of the panels will have a straightening effect even without any pressure being applied. Some users with very curly (or frizzy) hair may for example wish to remove some but not all of the curl. Also, some users with very limp hair may not wish to fully straighten their hair. Arranging for a predetermined and controlled gap between the panels can facilitate the desired partial straightening for those users, and can also add shine to the length of hair as with conventional straighteners.

The device may for example provide a number of user-selectable settings defining a number of different predetermined spacings between the panels, the different spacings providing different degrees of hair straightening. Desirably, one setting would allow the panels to engage one another so that they can be pressed together with a length of hair therebetween, for maximum straightening.

According to a second aspect of the invention there is provided a hair styling device having a first hair-straightening panel and a second hair-straightening panel, the first hair-straightening panel and the second hair-straightening panel facing one another and being movable relative to one another, the device having a first heating element for the first hair-straightening panel, a second heating element for the second hair-straightening panel, and a distributing component mounted upon the first hair-straightening panel, the distributing component having a number of elements which project towards and are engageable with the second hair-straightening panel, the distributing component being movable relative to the first hair-straightening panel.

The inventors have therefore appreciated that the distributing component can be a preferable but subsidiary feature of the invention according to the first aspect as set out above, or it can instead be a feature added to an otherwise conventional pair of hair straighteners. Thus, whilst it is known to provide fixed combs and other similar structures for hair straighteners, the provision of a movable distributing component has additional benefits as described herein.

In particular, with conventional straighteners it is necessary to clamp the length of hair between the panels as set out above. However, as also above described there are benefits to controlling the spacing between the panels so that the length of hair passes through a controlled passage between the panels, with a controlled (and perhaps zero) pressure being applied to the hair. In such cases the distributing component can ensure that the length of hair is retained between the panels and does not for example slip out of the gap between the panels.

Also, less diligent users may seek to pass a tight bunch of hair between the panels rather than passing a more suitable ribbon-like length of hair. A distributing component (or multiple distributing components, as desired) can be used to help spread a bunched length of hair into a more ribbon-like form.

Furthermore, it is expected that a moving distributing component will reduce slightly the force required to pull the length of hair between the panels.

Preferably, the distributing component is in the form of a helical element such as a worm gear or spring as described in relation to the drawings below. Preferably also, it is arranged that the distributing component is driven to oscillate. The oscillations may comprise less than one rotation of the worm gear or spring. Whilst an oscillating movement of the distributing component will cause oscillating movement of the length of hair as it passes the distributing component, that oscillating movement is expected to help to spread out the hair more evenly across the panels.

The particular form of the distributing component and the benefits thereof which are described above in relation to the first aspect, and which are described below in relation to the specific embodiments, are applicable also to this aspect of the invention.

According to a third aspect of the invention there is provided a hair styling device having:

a body defining a first chamber and a second chamber, each chamber being adapted to accommodate a length of hair, an opening through which the length of hair may pass into the chambers;

a rotatable element adapted to engage the length of hair adjacent to the opening, the rotatable element being located between the first chamber and the second chamber;

a first protrusion within the first chamber and a second protrusion within the second chamber, around which, in use, the length of hair is wound by the rotatable element, the first protrusion having a free end and the second protrusion having a free end.

The identified prior art documents describe hair styling devices having first and second chambers with the rotatable element therebetween. In those devices the protrusion within one of the chambers (and in particular within the "front" chamber as described) is an elongate member around which the length of hair is wound. The other protrusion is located within the other chamber (and in particular within the "rear" chamber as described) and is configured as a shaft for the rotatable element. Only the elongate member has a free end from which a formed curl can be removed without deformation, and the user is instructed to orient the device with the free end of the elongate member facing her head during use.

According to the third aspect of the present invention, the device can be symmetrical, with each of the chambers able to act as the "front" chamber (i.e. facing towards the user's head), and the other chamber acting as the "rear" chamber (i.e. facing away from the user's head). The user can therefore orient the device with either of the protrusions facing towards her head; whichever of the first and second chambers is oriented towards the user's head will provide the equivalent of the front chamber of the prior art devices.

The cross-sectional dimension (e.g. diameter) of the first chamber may differ from that of the second chamber, so that the user can form large or small curls depending upon the orientation of the device. Similarly, the cross-sectional dimension of the first protrusion may differ from that of the second protrusion. The protrusions may be of different lengths, and the chambers may also be of different lengths, as desired.

According to a fourth aspect of the present invention, there is provided a hair styling device having:

a body defining a chamber adapted to accommodate a length of hair, an opening through which the length of hair may pass into the chamber;

a first rotatable element and a second rotatable element, each adapted to engage the length of hair adjacent to the opening, a protrusion within the chamber, around which, in use, the length of hair is wound by the first rotatable element and the second rotatable element, the first rotatable element being rotatable independently of the second rotatable element.

Embodiments of the fourth aspect of the invention utilise two rotatable elements which can rotate independently and therefore relative to one another. During some styling operations it may be desirable for both rotatable elements to rotate together in synchrony. In other styling operations the rotatable elements can rotate in opposite directions (at the same rotational rate or at different rotational rates). In yet other styling operations one of the rotatable elements can be rotated whilst the other is held stationary.

All aspects of the present invention may be combined with features of one or more of WO2009/077747, WO2012/080751, WO2013/186547 and PCT/GB2014/051386 with which they are compatible. Also, the differing aspects of the present invention may be used together with other aspects with which they are compatible.

BRIEF DESCRIPTION OF THE PREFERRED EMBODIMENTS

The invention will now be described in more detail, by way of example, with reference to the accompanying schematic drawings, in which.

DETAILED DESCRIPTION

Figure 1:
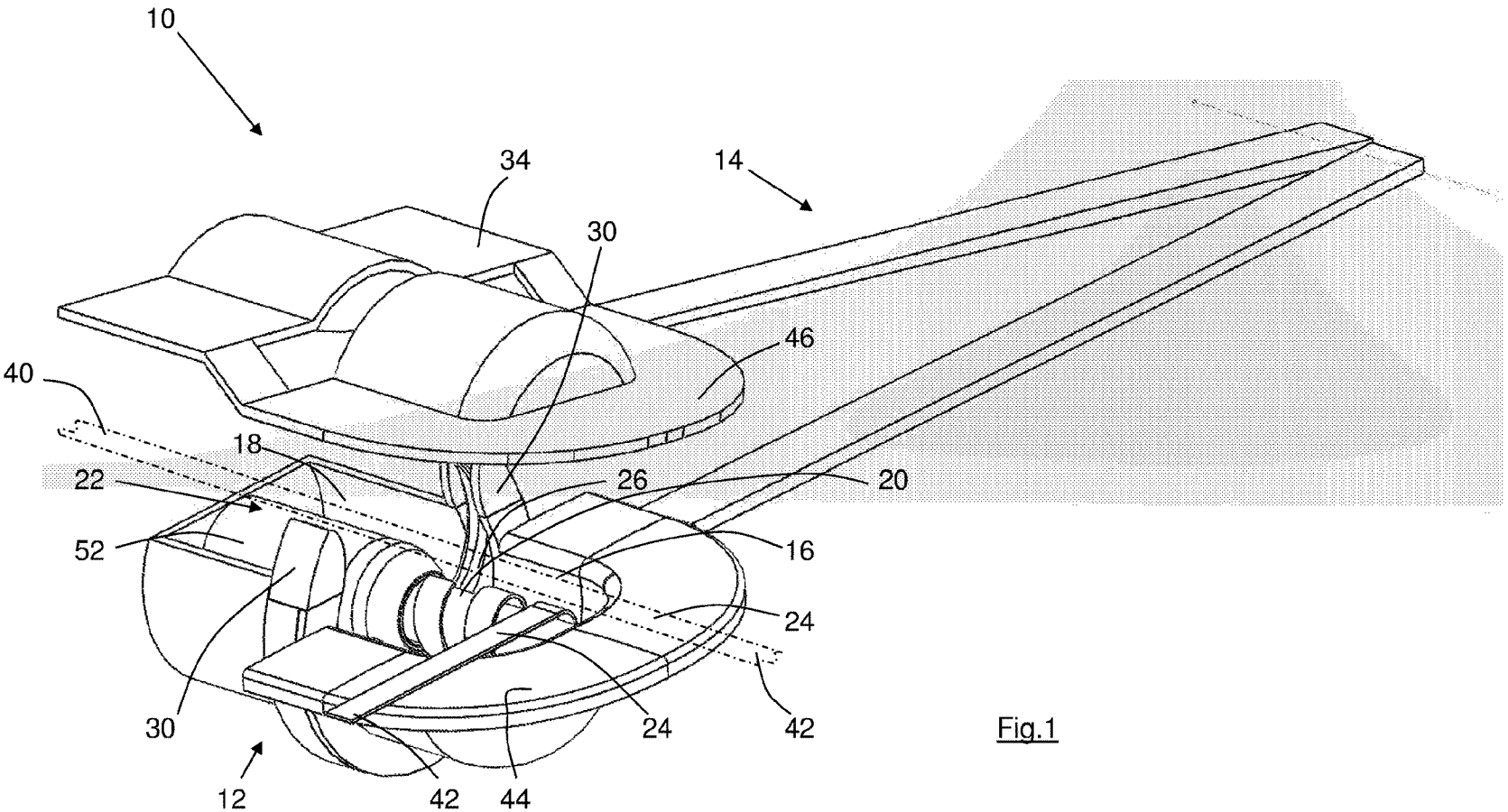
FIG. 1 shows a perspective view from above of a first embodiment of hair styling device according to the first aspect of the present invention.

The hair styling device 10 has a body 12 and a handle 14. Within the body 12 is a front chamber 16 and a rear chamber 18. A protrusion 20 is located within the front chamber 16. The body 12 has an opening 22 through which a length of hair 24 may be introduced into the chamber 16.

It will be observed that the protrusion 20 of the embodiments of FIGS. 1-5 is of a similar size and shape to the elongate member of the described prior art documents. It will be understood, however, that in embodiments designed solely for hair straightening the length of the protrusion is unimportant, and in those embodiments the protrusion could be very short. Whilst it is to be expected that a short protrusion would cause the length of hair to be wound into inconsistent curls that is not a disadvantage if the length of hair is subsequently to be straightened. Accordingly, all that is required is that the protrusion cooperates with the rotatable element to ensure that the length of hair becomes wound therearound.

In FIG. 1 the length of hair 24 is shown in solid lines in the position in which it has been fully wound onto the protrusion 20. For ease of reference the length of hair 24 is also shown in dotted lines in the (approximate) position in which it may be introduced into the device 10.

The device 10 has a rotatable element 26 which lies between the front chamber 16 and the rear chamber 18 and separates those chambers. The rotatable element 26 can be driven to rotate by a motor (not shown).

Figure 6:
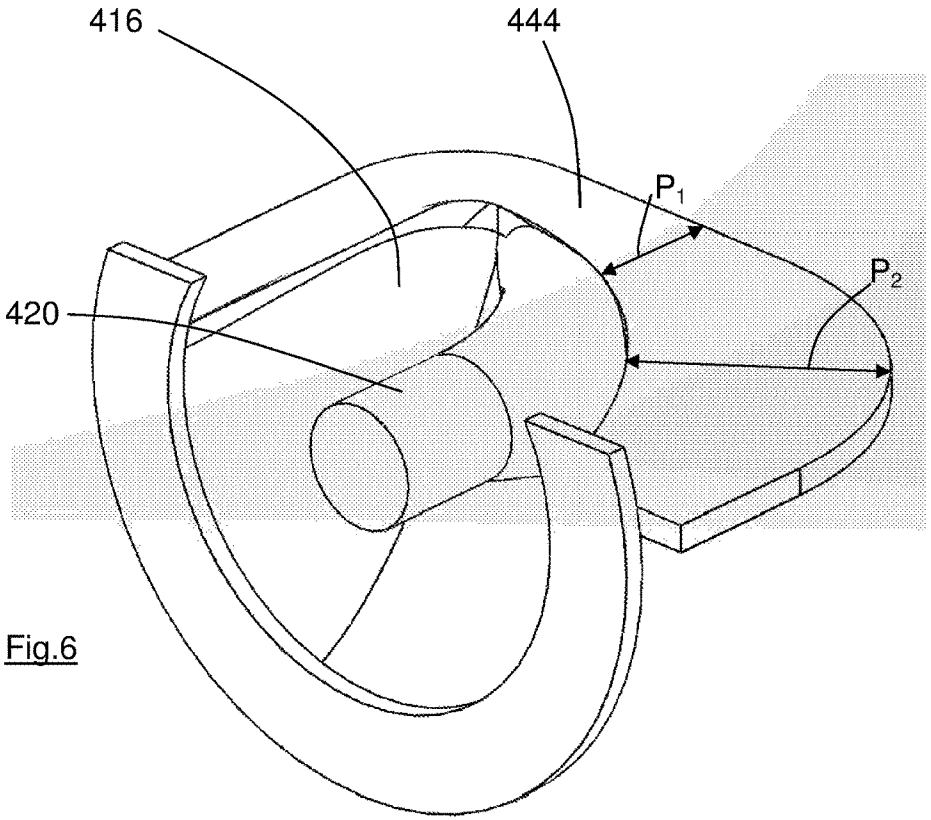
FIG. 6 shows a view of part of the chamber and elongate member of a fourth embodiment of the invention according to the first aspect.

In this embodiment the protrusion 20 is fixed to the body 12 (see for example FIG. 6).

In other embodiments the protrusion rotates with the rotatable element 26. In those other embodiments the protrusion may terminate before the end of the front chamber 16. Whilst it would be possible in those other embodiments for at least some of the length of hair to pass around the end of the protrusion after it has been formed into curls, that is not expected to be significantly detrimental when the device is operated in the hair-straightening mode.

The rotatable element 26 in this embodiment is located within a fixed channel member 30. The channel member 30 serves firstly to reduce the likelihood of the rotatable element engaging extraneous hair during use of the device, and secondly to provide guides to assist the user in correctly inserting the length of hair 24. Thus, it will be understood that prior to use of the device the user must place the device close to her head with the length of hair lying adjacent to the opening 22 and between the upstanding ends of the channel member 30. The upstanding ends of the channel member 30 will in particular assist the user in correctly positioning the length of hair 24, especially when the user is unsighted.

It will be understood that the introduction of the length of hair 24 adjacent to the opening 22 may be facilitated in other embodiments by one or more fixed inclined surfaces, and/or by one or more movable guide parts, as described in the identified prior art patent documents.

Figure 3:
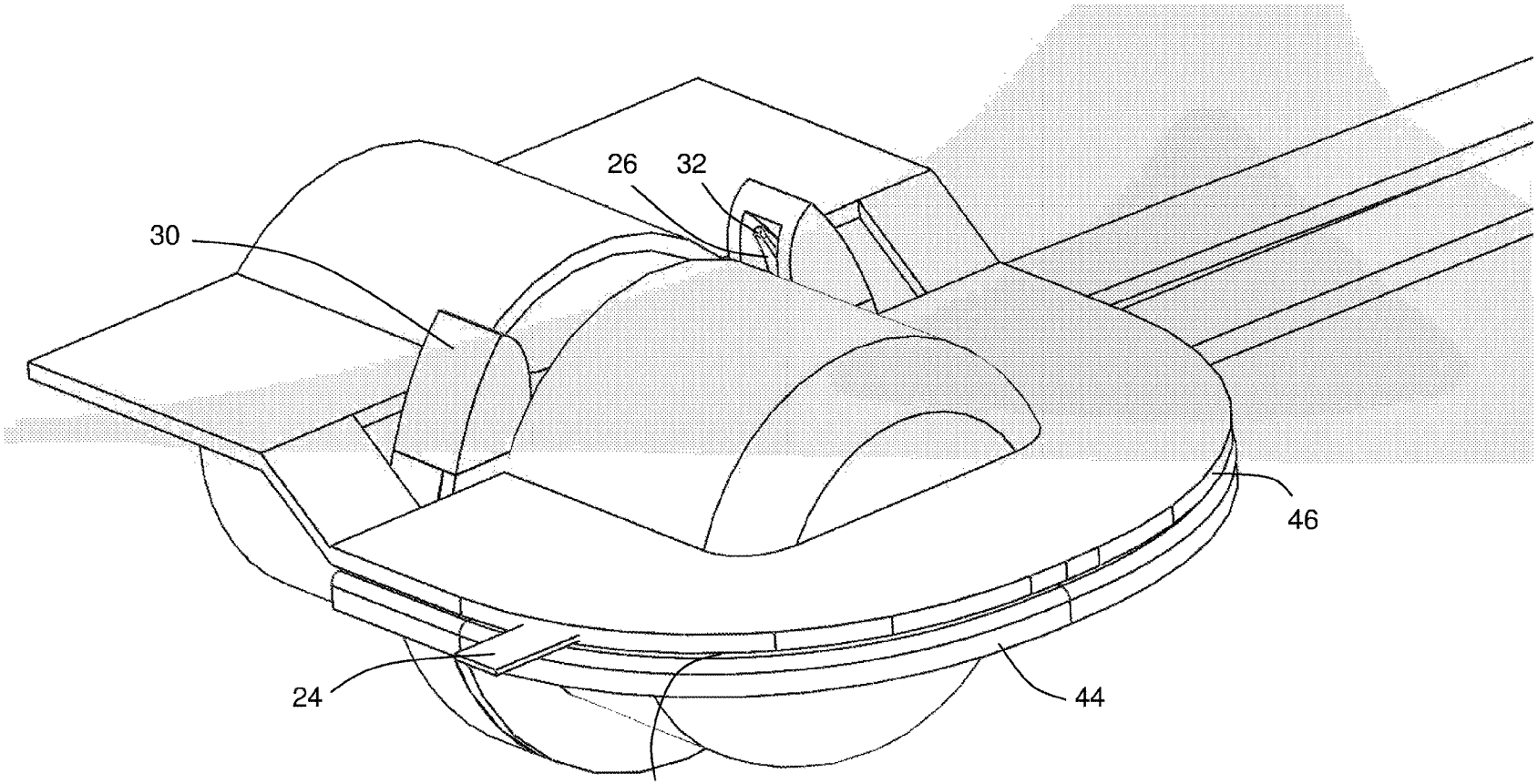
FIG. 3 shows a perspective view of the embodiment of FIGS. 1 and 2 with the first and second hair-straightening panels pressed together.

During the initial stages of operation, after the length of hair 24 has been placed close to the opening 22 as shown in dotted outline, the handle parts are moved (pivoted) together which causes the movable cover member 34 to move downwardly as drawn in FIG. 1, into the position shown in FIG. 3. In that position the front chamber 16 is effectively fully enclosed, and the length of hair 24 has been pressed towards the protrusion 20. In most embodiments of the invention the movement of the movable cover member 34 will be controlled by the user, i.e. by the user squeezing together the respective handle parts as in conventional hair straighteners. It is possible, however, that the movement of the movable cover member is automated.

Figure 2:
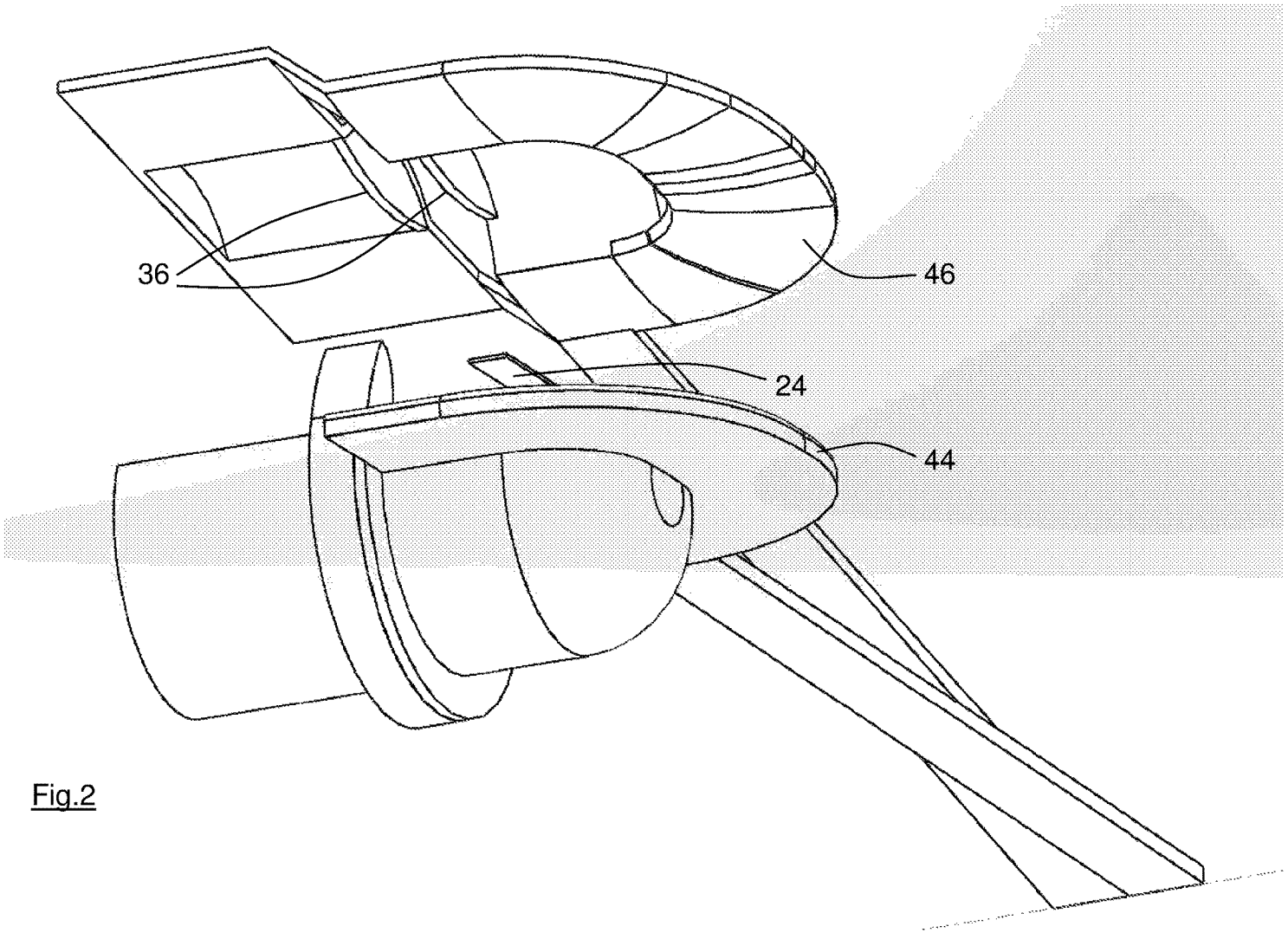
FIG. 2 shows a perspective view of the embodiment of FIG. 1, from below.

The rotatable element 26 is then rotated (clockwise as viewed in FIG. 1), and its leading end (not seen, but in this embodiment of identical form to its trailing end 32) will pass over the length of hair 24 and capture the length of hair 24. It is preferably arranged that the controller of the device 10 will not allow the rotatable element 26 to commence its rotation until the movable cover panel 34 has been moved to its closed position. Thus, the configuration of the movable panel 34 is such that when it is in its closed position it presses the length of hair 24 to a position inside the path of movement PM (see FIG. 8) of the leading end of the rotatable element 26. As shown in FIG. 2, the movable panel 34 carries two pressing parts 36 which engage the length of hair and help to ensure that it is pressed inside the path of movement PM.

Figure 8:
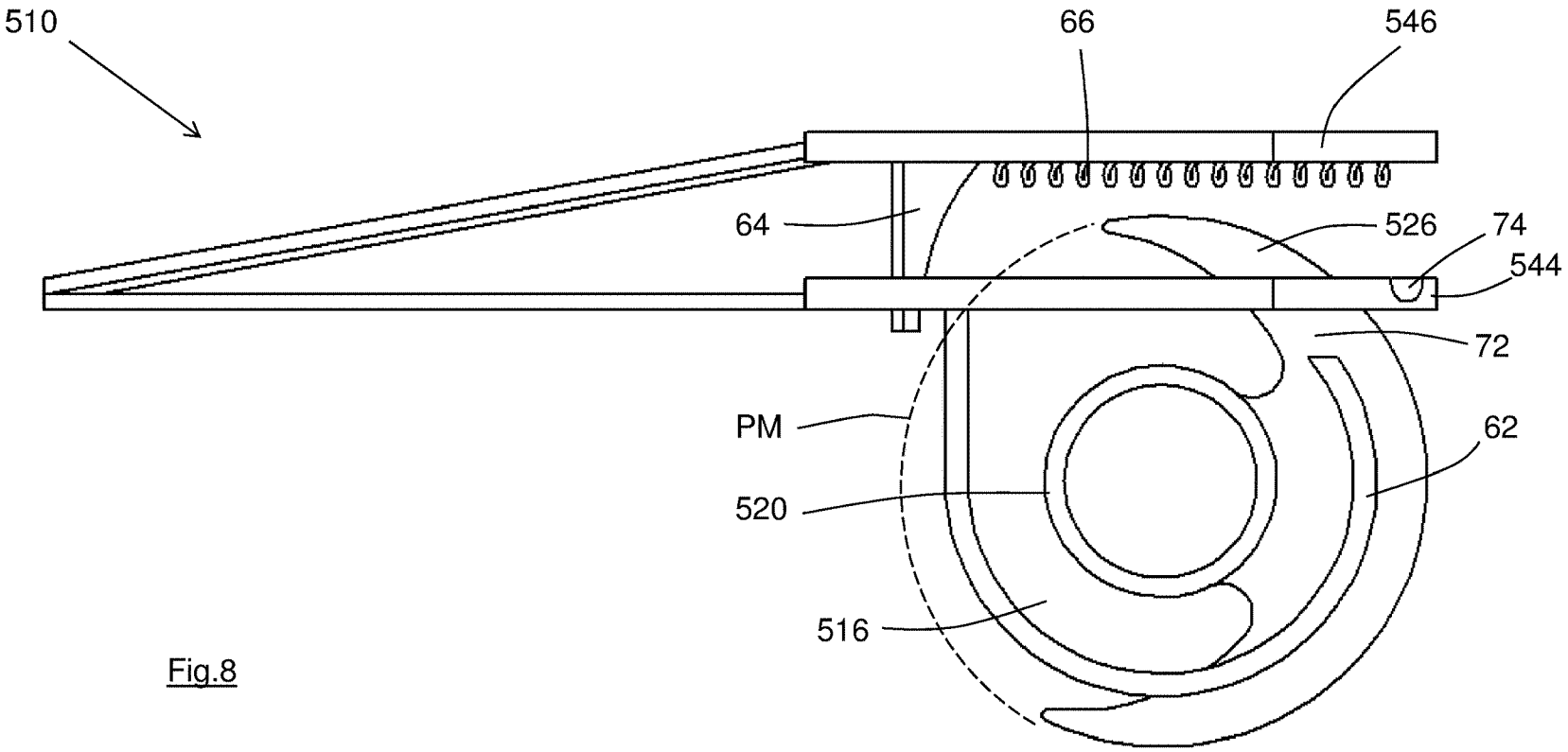
FIG. 8 shows a view in the direction VIII of FIG. 7.
Figure 10:
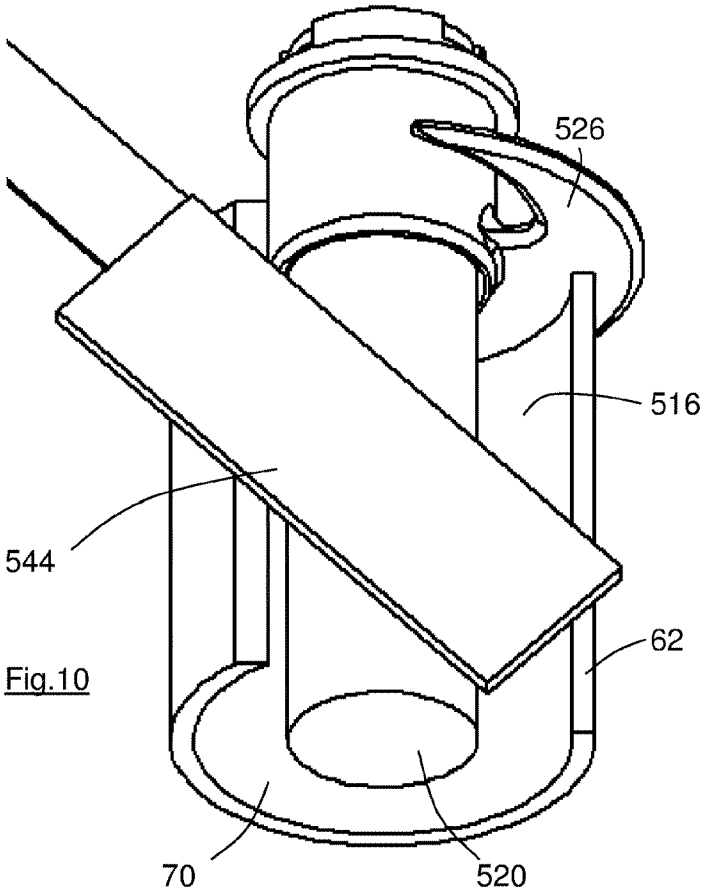
FIG. 10 shows a perspective view of the hair styling device of FIGS. 7 and 8.

It will be understood that one or both of the pressing parts can in other embodiments extend downwardly behind the opening 22 as viewed in FIGS. 1 and 2 (perhaps being shaped somewhat similarly to the guide part 64 of the embodiment of FIG. 8) to act as a combined guide part and pressing part.

The rotatable element 26 tapers towards its leading end such that its rotation acts to pull the length of hair 24 downwards as viewed in FIG. 1, through the opening 22.

Considering the dotted outline length of hair 24 shown in FIG. 1, the end 40 is the free end of the length of hair, and the part 42 is attached to the user's scalp (not shown). The hair styling device 10 is intended to style substantially all of the length of hair 24 lying between the part 42 and the free end 40, so that the numeral 42 represents the "end" of the length of hair 24 which will be styled by the device. Each of the individual hairs in the length of hair 24 will be connected to the user's scalp (not shown), and in practice the length of hair will usually be considerably longer than that represented in FIG. 1 (i.e. the length of hair will in practice normally extend a significant distance beyond the left edge of the page).

It will be understood that in all embodiments of the invention the distal end 40 of the length of hair is not clamped or otherwise constrained when the device is in the closed position (such as that of FIG. 3), so that little force is required to draw the length of hair into the device. The proximal end 42 might also not be clamped between the panels 44, 46, but since the proximal end of the length of hair does not need to move it may be clamped (or partially-clamped) if desired.

In common with the prior art devices described above, the device is placed close to the user's scalp, so that the part 42 might in practice be very close to the scalp. As the rotatable element 26 rotates, the distal portion of the length of hair 24 (which lies between the rotatable element 26 and the free end 40), is pulled through the opening 22 into the rear chamber 18. The rear chamber 18 has a closed end which provides a relatively fixed surface and it is the relative rotation between the rotatable element 26 and the opening 22 (and in particular its closed end) which causes the distal portion of the length of hair 24 to be drawn into the device 10.

The proximal portion of the length of hair 24 (which lies between the rotatable element 26 and the part 42), will be pulled through the opening 22 and into the front chamber 16. The first hair-straightening panel 44 is also a relatively fixed surface, and it is the relative rotation between the rotatable element 26 and the first panel 44 which causes the proximal portion of the length of hair 24 to be drawn into the device 10. Furthermore, since the part 42 of the length of hair is attached to the user's scalp, only a small part of the proximal portion of the length of hair will be drawn into the device—continued rotation of the rotatable element 26 instead causes the distal portion of the length of hair to be drawn from the rear chamber 18, past the rotatable element 26, and into the front chamber 16.

It will be observed that the location of the part 42 of the (solid) length of hair 24 differs from the location of the part 42 of the (dotted outline) length of hair 24. This will be caused in use by the user moving the device 10 relative to her head, but in this embodiment is unimportant to the operation of the device. It will be seen that the first hair-straightening panel 44 and the cooperating second hair-straightening panel 46 have relatively large areas, so that the user can manipulate the device 10 to a convenient position, with the proximal portion of the length of hair lying within the passage 50 between the first and second panels 44, 46.

In this embodiment the front chamber 16 and the rear chamber 18 are both heated, in this embodiment by way of discrete heating elements (not seen) in the walls of the body 12 and in the movable panel 34. Also, one or more heating elements can be located within the elongate member 20 and the shaft 52 within the rear chamber, if desired. Finally, there can be heating elements within each of the first panel 44 and the second panel 46.

The schematic drawings show only the basic structure of the handle 14, the body 12 and the movable panel 34. In practice, a controller will typically be located in one or other of the handle parts, the controller being connected to the motor for the rotatable element 26, and to each of the heating elements. The controller can set the temperature of each of the heating elements (separately and independently if desired), and can also set the rate of rotation of the rotatable element (which will determine the speed at which the length of hair is introduced into the rear chamber 18 and subsequently into the front chamber). The controller can also issue an audible and/or a visual signal to the user after a predetermined period of time, the period of time being chosen to allow the length of hair to reach the temperature required for effective styling.

Preferably also, the controller is able to detect the position of the rotatable element (or at least to detect its position once each rotation). Ideally, the rotatable element carries a magnet and the controller is connected to a Hall effect sensor which can detect the proximity of the magnet, for example. Such an arrangement can ensure that the rotatable element always undertakes a complete number of rotations and stops rotating at a predefined position ready for the commencement of the next curling operation, as described in the prior art documents.

The user may be able to choose from a number of pre-set programmes having different heating regimes, different rates of rotation of the rotatable element, and/or different heating periods. Alternatively or additionally, the controller can determine the temperature regime, the rate of rotation and the heating duration depending upon the thickness of the length of hair which is introduced into the device.

In particular, it will be understood that it is safer if the maximum temperature applied by the heating elements occurs within the front chamber 16 rather than between the panels 44, 46, since it will be far less likely that the user will inadvertently touch a part of the front chamber 16. Whilst it might in some embodiments be possible not to provide a heating element for the first panel 44 or the second panel 46, and instead to rely upon the heat which has been imparted into the hair within the front chamber 16, it is expected to be necessary that the first and second panels 44, 46 are also heated. It might also be possible not to provide any heating elements within the front or rear chambers 16, 18, and instead to rely solely upon the heat applied by the first and second panels 44, 46. That is not preferred, however, and it is a beneficial feature of the present invention that the pre-heating of the length of hair 24 which takes place in the chamber (in particular within the front chamber 16) reduces the temperature to which the panels 44, 46 must be heated, without compromising their straightening effect.

Also, it might be desirable in some applications to rely upon styling the hair chemically rather than by way of heat (or in addition to the application of heat), in which case a suitable hair-treatment product can be applied to the length of hair 24 whilst it is contained within the chamber, ideally within the front chamber 16. The device can utilise steam, ions, and/or any suitable chemicals to treat the hair as part of the styling process.

After the length of hair 24 has been retained within the front chamber 16 for the desired length of time, the device is pulled away from the user's head, with the length of hair 24 passing between the panels 44, 46 as it is removed from the front chamber 16.

Whilst FIG. 1 shows the length of hair 24 in solid outline wound around the elongate member 20 with the movable member 34 open, that is an artificial situation provided for the purposes of understanding. Instead, the movable member 34 will remain closed until the length of hair 24 has been removed, specifically so that the length of hair 24 passes between the panels 44, 46 as it is removed. It will be understood from FIG. 3 that the passage 50 through which the length of hair 24 is pulled as it is removed from the front chamber 16 is small, perhaps equal to the thickness of a few hairs, the user being able to impart a desired pressure to the length of hair between the panels 44, 46, similar to the operation of conventional hair straighteners. In an alternative embodiment the size of the passage 50, and the pressure applied to the length of hair 24 as it passes between the panels 44, 46, are automated, the device having means to move the panels relative to one another and the controller determining the gap between the panels and/or the pressure which is applied therebetween. Thus, in alternative embodiments the first panel may not be an extension of the body 12, and/or the second panel may not be an extension of the movable member 34, but instead the panels are otherwise mounted adjacent to the first chamber. An automated device may be able to apply a more consistent pressure to the length of hair than could be achieved manually, even for an experienced user.

It will be understood that the action of winding the length of hair 24 around the protrusion 20 will typically cause the length of hair to bunch together, i.e. to form a relatively tight bundle having a circular or oval cross-section. It is desired, however, to flatten out the bundle as it passes between the panels 44, 46, so as to ensure that all (or substantially all) of the individual hairs within the length of hair 24 experience the same or similar pressure and temperature regime between the panels. Alternatively stated, it is not desired that the length of hair retains a bundled form since the individual hairs close to the centre of the bundle would then be partially shielded from the temperature of the panels by the surrounding hairs.

Whilst it might be expected that pressing the panels 44, 46 together will induce the length of hair 24 to spread out into a ribbon-like form, this spreading might not be sufficient on its own, and it is desired that additional means of spreading the length of hair across a larger area of the panels be provided. One such means is shown in FIG. 4.

Figure 4:
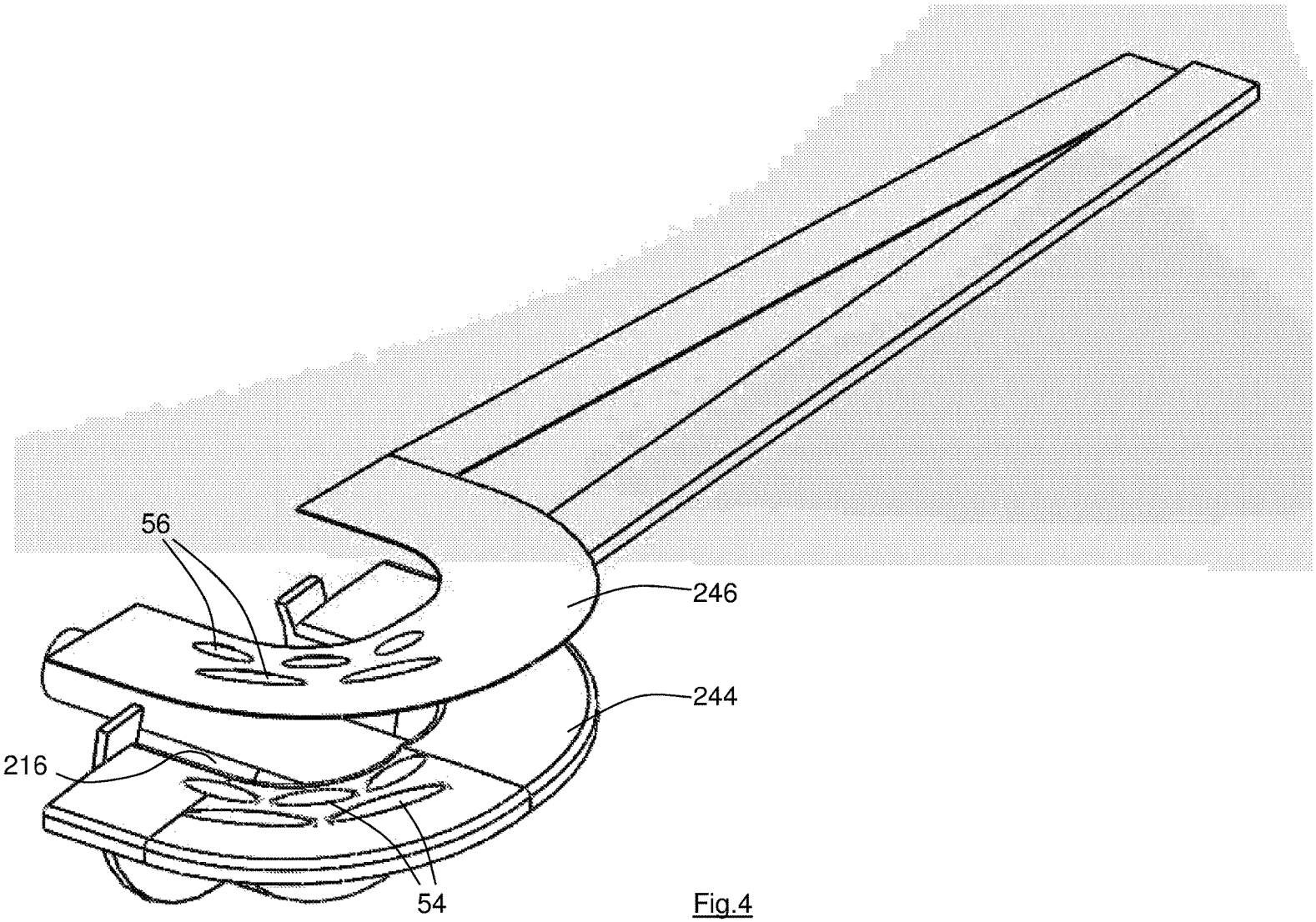
FIG. 4 shows a perspective view of part of a second embodiment of the invention according to the first aspect.

In the embodiment which is shown partially in FIG. 4 the first panel 244 carries a number of rollers 54 which project slightly above the surface of the panel 244 (and in this embodiment project into corresponding shallow recesses 56 formed in the second panel 246). The rollers 54 engage the hair as it passes thereover and impart a small sideways force to the individual hairs causing the length of hair to become more spread out. The rollers may also be supplemented by a comb or one or more rows of bristles at the edge of the front chamber 216 which will also act to spread out the length of hair before it passes between the panels 244, 246.

The number and disposition of the rollers shown in FIG. 4 is by way of example, and a simpler embodiment could use just two rollers lying side by side with an angle therebetween. The rollers could have a roughened surface, or have projections or bristles, to impart a sideways force to the passing hair.

Figure 5:
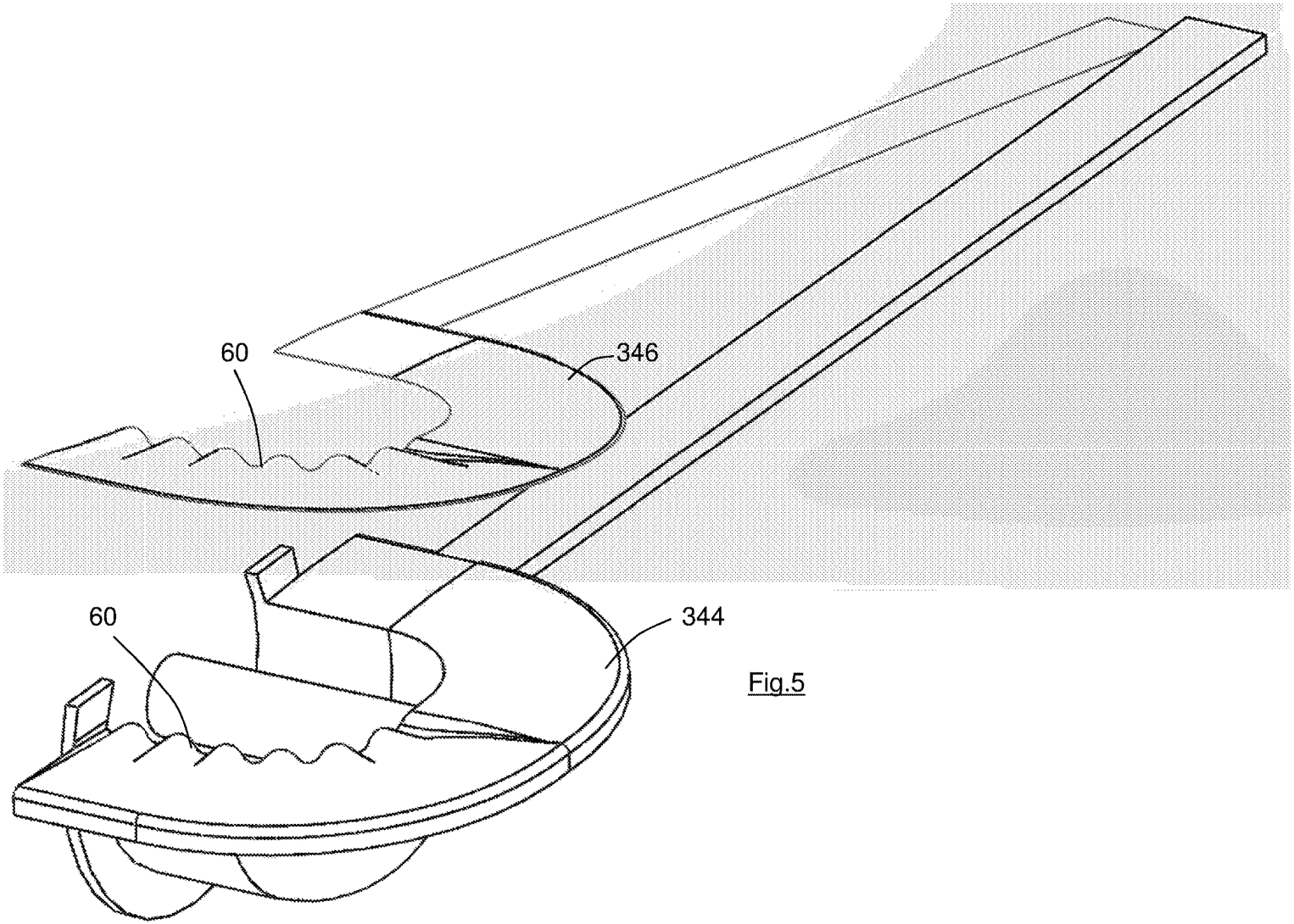
FIG. 5 shows a perspective view of part of a third embodiment of the invention according to the first aspect.

Another alternative embodiment is shown (partially) in FIG. 5, in which the panels 344, 346 have cooperating wave-forms 60. The waves 60 diverge across the panels 344, 346 and thereby urge the length of hair to become more spread out.

It will be seen from FIG. 1 that the hair-engaging surface of the first panel 44 is substantially tangential to the protrusion 20 (so that the passage 50 is also substantially tangential when the movable member 34 is in its closed position). It is desired that the length of hair is wound in the direction shown in FIG. 1 so that the curvature of the length of hair as it is pulled from the protrusion 20 and through the passage 50 is linear (or substantially linear) so as to enhance the straightening effect. It will be understood, however, that the tangential configuration is not essential, and if desired the passage 50 could be inclined downwardly or upwardly (as drawn). In the alternative embodiment shown partially in FIG. 6 the protrusion 420 is flared, and is blended into the end wall of the front chamber 416. In this embodiment the top of the protrusion 420 is substantially continuous with the hair-engagement surface of the first panel 444, it being recognised that the elongate member need not be cylindrical in embodiments which are not intended to form consistent curls. It will nevertheless be understood that if the hair is heated (and/or treated) within the front chamber 16 it will necessarily be styled into a curved form. Those curls (and any pre-existing curls or waves in the length of hair 24) can subsequently be removed as the length of hair 24 is passed between the panels 44, 46. The degree to which the curls are initially formed, and are subsequently removed, can be determined in part by the temperature regimes within the device, i.e. the temperature to which the length of hair is heated within the front chamber 16 and the temperature which the length of hair subsequently experiences between the panels.

Also, the user can affect the degree to which the length of hair is straightened by altering the rate at which the length of hair passes between the panels 44, 46. Thus, if the user pulls the device 10 rapidly away from her head (or otherwise pulls the length of hair rapidly through the passage 50), especially whilst applying little or no pressure to the length of hair, the straightening effect of the panels will be minimised. Alternatively, if the user pulls the device more slowly away from her head, especially whilst applying significant pressure to the length of hair, the straightening effect will be maximised.

Notwithstanding the benefit of the invention in enabling the use of a lower maximum temperature of the heating elements, it may nevertheless be desired to use a similar maximum temperature as that which is used in conventional hair straighteners. Thus, the speed of operation might be an important factor to some users, and raising the maximum temperature will increase the rate at which the hair is heated, and thereby enable the styling of the hair to be undertaken more quickly. Even so, however, provided that the maximum temperature is applied within the front chamber, the likelihood of the user suffering pain through touching a heated surface, or of damage to a worktop or the like, is reduced because the heating element(s) within the front chamber are not exposed. There is another benefit in that the hair is not exposed to the maximum temperature, and to the pressure between the panels, at the same time, so that the likelihood of damage being caused, particularly to the hair of frequent users, is reduced. Alternatively stated, preheating the length of hair to a very high temperature within the chamber allows the length of hair subsequently to be pulled relatively quickly between the panels, reducing the time for which the length of hair is exposed to the pressure therebetween.

The device 10 can therefore be used to impart curls to the length of hair within the front chamber 16, which curls are subsequently partially or fully removed by the panels 44, 46 etc. as desired. Clearly also the device can be used to remove pre-existing curls or waves, including the very tight curls of frizzy hair, if desired.

FIG. 6 shows another benefit of the present invention, namely that the width of the panels can vary. In the embodiment shown, the width $P_1$ of the first panel 444 (and similarly the second panel (not shown)) in the direction aligned with the protrusion 420 is smaller than the width $P_2$. The user can manipulate the device 10 so as to determine the portion of the panels between which the length of hair passes as it leaves the chamber 416, and can thereby determine the width of the panels which must be passed. It is known for some users to have different-width hair straighteners, and that wider panels create a different styling effect than narrower panels; the requirement for different width panels is avoided by the device represented in FIG. 6. It will be understood that the width $P_1$ may be substantially narrower than the width of conventional hair straighteners, the preheating of the length of hair which is possible with the present invention making it possible to achieve the desired straightening effect with narrower panels.

Whilst the length of hair will typically lie alongside the outer wall of the chamber 416 when it is not under tension, as the length of hair is pulled from the chamber 416 it is expected that the curls will tighten somewhat around the protrusion 420. The flaring of the protrusion 420 in FIG. 6 is expected to at least partially spread out the length of hair into a more ribbon-like form as it passes out of the chamber 416, prior to the length of hair being further spread out as it passes between the first 444 and second panels.

The invention has been described for use with heating of the chamber and/or panels, or with a hair treatment product, to facilitate styling. The panels 44, 46 etc. could be heated directly by heating elements as described, or alternatively by a heated fluid. For example, the panels may be formed with conduits therethrough, which conduits can receive a fluid. The body of the device can have a heater to heat the fluid and a pump to pump the fluid through the conduits (the pump suitably being an impeller or fan if the fluid is air, for example). In a modification of such a device, the panels 44, 46 etc. could if desired be cooled by the passage of the fluid, i.e. a particular styling operation could require the heating of the hair within the chamber, followed by the cooling of the hair as it is pressed between the panels.

Also, whilst the length of hair 24 is shown in FIG. 1 as leaving the device 10 in a direction substantially aligned with the passage 50, that is not always necessary. The user, could for example manipulate the device 10 so that the length of hair is forced to undertake a sharp bend around the edge of the panel 44 (or the panel 46, as desired), the forced bending of the hair as it leaves the device 10 providing a part of the styling operation. Furthermore, the rotatable element is preferably symmetrical and can if desired rotate in either direction. If the device is operated so that the end 32 is the leading end of the rotatable element 26 the length of hair 24 will be wound the opposite way around the protrusion 20 to that represented in FIG. 1. The length of hair 24 will then be forced to pass around a relatively sharp bend as it leaves the chamber and passes through the passage 50, and that might also provide part of the styling operation.

As above indicated, whilst in the embodiments shown the panels are aligned substantially perpendicular to the closing direction of the cover member 34, that is not necessarily the case, and the panels could be inclined upwardly or downwardly relative to the closing direction, as desired.

Figure 7:
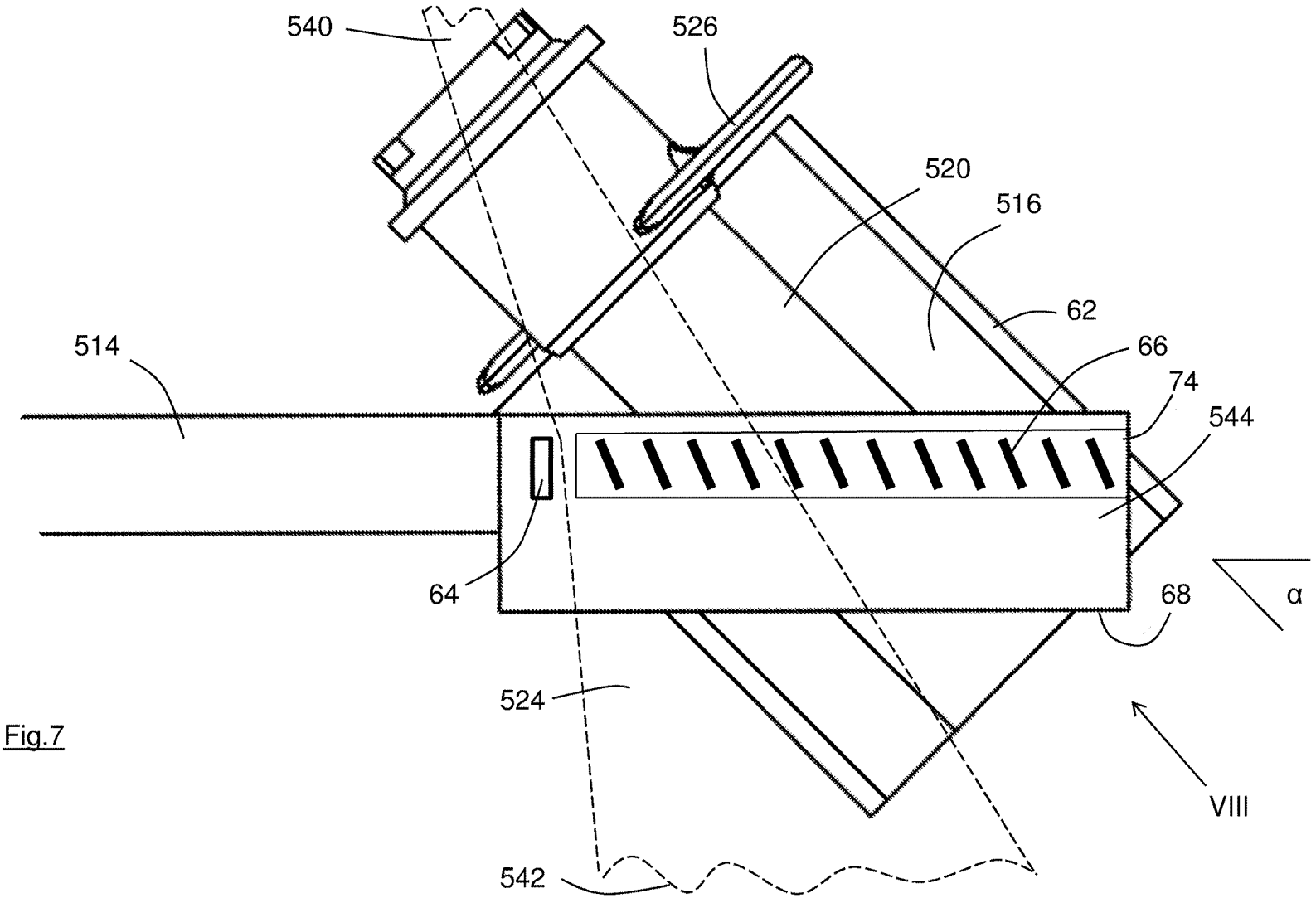
FIG. 7 shows a plan view of part of a fifth embodiment of the invention according to the first aspect.

The plan view of FIG. 7 shows a part of an alternative embodiment, specifically the protrusion 520, the rotatable element 526 and the first panel 544. As with the earlier embodiments, the protrusion 520 is located within front chamber 516. The wall 62 of the front chamber 516, and/or the protrusion 520, and/or the first panel 544, and/or other parts of the hair styling device 510, can be heated so as to heat a length of hair during use.

It will be understood that when a user is seeking to impart curls into her hair she will typically grasp a bunched (roughly circular) section of hair, whereas when a user is seeking to straighten her hair she will typically grasp a wide thin section of hair, (although it will be understood that this distinction is for guidance only and is not recognised by all users).

A wide thin section of hair 524 is represented in dashed outline in FIG. 7. It will be understood that the dashed lines represent the periphery of the length of hair 524, individual strands of hair substantially filling the region between the dashed lines. The user holds a selected section of hair (typically between two of her fingers) and inserts it into the hair styling device 510 along the path indicated in FIG. 7. It will be understood that the proximal end 542 of the length of hair 524 is attached to the user's scalp, and so retains its wide and thin form at that end (i.e. it is relatively wide in the left-to-right direction and viewed, and relatively thin in the direction into and out of the paper as viewed). The distal or free end 540 is inserted between the first panel 544 and the second panel 546 (see FIGS. 8 and 9) and moved towards or against the guide member 64 which is carried by the second panel 546.

The device 510 may include additional guides, such as inclined surfaces or the like, in front of or behind the rotatable element 526 as desired, whereby the distal end 540 is formed into a narrower, more bunched form, as shown. It will be understood that many of the guides which are described in the identified prior art documents could be used (either singly or jointly) in the present invention as an aid to ensuring that the length of hair is correctly inserted. Also, the pressing parts which are described specifically in WO 2012/080751 and WO2013/186547 could also be incorporated.

It will be understood that the length of hair 524 must be placed within the path of movement PM (FIG. 8) of the rotatable element 526 so that it is captured by the rotatable element and wound around the elongate member 520 as the rotatable element rotates. Alternatively, the length of hair 524 must be placed sufficiently close to the path of movement PM so that it can be driven into the path of movement as the panels 544 and 546 are brought together (i.e. as the device is closed) prior to rotation of the rotatable element. It will be understood that the provision of a guide member 64, and perhaps the provision of additional guide members as desired, allow the user to deform the ribbon of hair 524 into a more bunched form as it passes through the device 510, and that will make it easier to ensure that all of a length of hair 524 is captured by the rotatable element 526.

It is also desirable, however, that the length of hair 524 retains its wide thin form across the first panel 544. This will help to ensure that the individual strands of hair within the length of hair 524 receive similar heat and pressure as they pass between the first and second panels 544, 546 upon leaving the chamber 516.

FIG. 7 also shows a part of a distributing component 66, namely the component which is provided to distribute the length of hair more uniformly across the panels 544, 546, and to encourage the length of hair 524 to adopt a ribbon-like form as it passes out of the chamber between the panels, despite the length of hair perhaps being in a rope-like form within the chamber 516.

Figure 9:
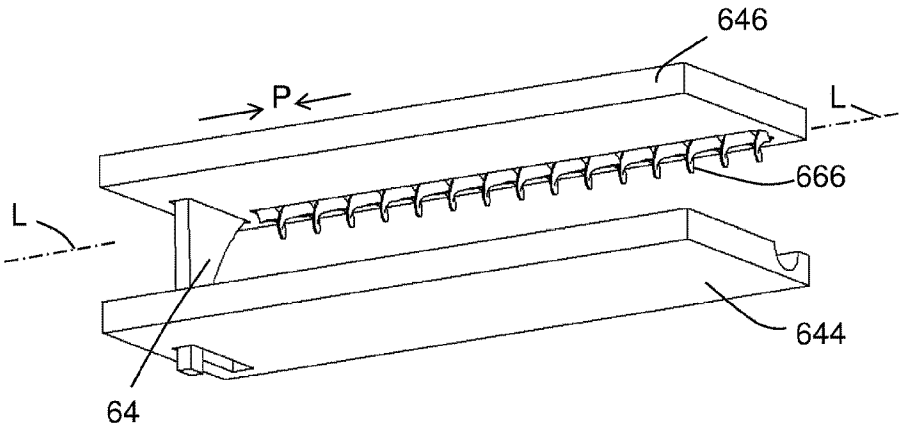
FIG. 9 shows a perspective view of the first and second hair-straightening panels, the guide member and the helical element of a sixth embodiment according to the first aspect.

In FIG. 7 the distributing component is in the form of a helical element 66, which is better seen in FIG. 8 (and see also the alternative embodiment 666 of FIG. 9). The helical element 66 in the embodiment of FIGS. 7 and 8 is a metal coil, and specifically a spring, whereas the helical element 666 is in the form of an Archimedes screw. The helical element 66, 666 is carried by the second panel 546, 646 and is represented in FIG. 7 to demonstrate its effect upon the length of hair 524.

As the length of hair 524 is inserted into the hair styling device it typically adopts a form similar to that represented in FIG. 7. The first panel 544 will ideally be placed close to the user's scalp, with the edge 68 very close to, and substantially parallel to, the scalp. The length of hair 524 is therefore held in its wide and thin form across much of the panel 544. When the device is subsequently closed the second panel 546 moves towards the first panel 544, whereupon the peaks of the helical element 66, i.e. those parts of the helical element which project towards the first panel, engage and then pass through the section of hair lying upon the first panel 544. The length of hair 524 is therefore separated into different sections by the peaks of the helical element 66. In the representation of FIG. 7 the first four peaks from the left-hand end of the helical element 66 lie between adjacent sections of the length of hair 524 and maintain the separation between those adjacent sections. The helical element 66 therefore acts to reduce or avoid the possibility that the length of hair 524 will bunch up adjacent to the guide member 64.

The separation of the length of hair 524 by the peaks of the helical element 66 is enhanced by the provision of a channel 74 within the panel 544 into which the helical element 66 can project. Since the length of hair 524 is held at its opposed ends it is not likely to be pressed into the channel and is therefore moved to either side of the peaks as the panels 544, 546 are brought close together.

It will be understood that in practice more than four of the peaks of the helical element 66 may engage the length of hair 524, and practiced users will likely seek to use a section of hair sufficiently wide to span much or substantially all of the first panel 544. In addition, it may be desirable for the user initially to lie the length of hair at a greater angle across the first panel 544, and perhaps even almost perpendicular to the edge 68; it may be possible for the user to re-direct the distal end 540 towards the rotatable element after the helical element 66 has engaged and retained the length of hair.

The length of hair 524 is subsequently wound around the protrusion 520 by the rotatable element 526, and during that winding much of the length of hair will be bunched (and perhaps twisted) into a more rope-like form. Regardless of the form which the length of hair adopts within the chamber 516, however, as the device 510 is subsequently pulled away from the user's head in order to remove the length of hair 524 from the device, the individual strands of hair necessarily follow the path determined by the helical element 66, i.e. they pass out of the chamber 516 between the respective peaks of the helical element 66. The helical element 66 therefore causes the length of hair 524 to spread out between the panels 544, 546 as it is removed from the chamber 516, and to adopt a wide thin form, ensuring more consistent heating and straightening of the individual stands of hair.

It is desirable that the helical element is a spring (or is otherwise deformable), in case the user has not removed all of the knots from her hair. If the length of hair 524 contains a knot, it may be that the knotted strands of hair lie to opposing sides of a peak of the helical element 66. The user can nevertheless pull the device 510 away from her head, and remove the length of hair 524, because the helical element 66 is sufficiently deformable to allow a knotted section of hair to pass over one or more of the peaks. In the alternative embodiment of FIG. 9, the helical element is an Archimedes screw made of silicone for the same purpose. Clearly, it could be arranged that a (non-deformable) distributing component is caused to move bodily out of the path of the length of hair if the removal force increases sufficiently because of a knot in the length of hair. A distributing component with a circular periphery such as that shown is advantageous in this respect as a knotted section of hair will be forced into the diminishing gap between the distributing element and the first panel 544, and thereby act to move the distributing element away from the first panel.

Another advantage of the helical element 66 is that it can be rotated about its longitudinal axis L-L (FIG. 9) to act as a worm gear and drive the length of hair 524 towards the left or right as drawn in FIGS. 7 and 9. This may be desirable if the length of hair has been positioned by the user too far to the left as drawn, i.e. too close to the rotatable element 526, for example.

It will be understood that a fixed distributing component can help to spread the length of hair across the panels as the length of hair is drawn out of the chamber, by virtue of the individual hairs being separated by the parts of the distributing component as above described. A movable (e.g. rotating) distributing component can serve the additional function of physically moving the length of hair across the panels. The distributing component can be driven to oscillate, whereby the length of hair is caused to oscillate relative to the panels, it being expected that oscillating movement will help to spread the length of hair more evenly between the projecting elements (e.g. peaks) of the distributing component, and might help to loosen knots in the length of hair.

It will be understood that the channel 74 for the helical element 66 is optional, and it will also be understood that the form and location of the distributing component can be varied without detriment to the invention. For example, the distributing component can comprise one or more movable combs, or a series of discrete elements which move together or sequentially to distribute the length of hair, or move the length of hair, across the surface of the panels. The distributing component (or components) may be mounted upon the first or the second panel (or both), and in any suitable location and orientation.

The distributing component can be a helical element with a variable pitch, and/or with sections having oppositely-directed helixes, as may be desired to achieve the distribution and/or spreading of the length of hair which is desired.

The first panel 544, or the second panel 546, can carry sensors to detect the position of the length of hair 524. The distributing component may be operated depending upon the sensed location of the length of hair (for example, the distributing component could be operated to move some of the length of hair towards the right as drawn in FIG. 7 if it is determined that too great a proportion of the length of hair lies adjacent to the guide member 64). The number of rotations which the helical element 66 must undergo in order to distribute the length of hair as desired can be determined and the controller configured accordingly.

Whilst the embodiments of FIGS. 1-6 are intended only for straightening hair, the embodiments of FIGS. 7-13 can also be used (alternatively) to impart curls into a length of hair. It will be seen from FIG. 10 for example that the chamber 516 is open ended, i.e. there is an annular secondary opening 70 surrounding the free end of the protrusion 520. Such an opening is present in the identified prior art documents and is provided to permit a curled length of hair to be removed from the chamber around the free end of the protrusion in order to retain the curled form. It will therefore be understood that these embodiments can be used to straighten a length of hair (passing the length of hair out of the chamber and between the first and second panels 544, 546), or to impart curls into the length of hair (bypassing the panels and sliding a formed curl out of the chamber around the end of the protrusion 520).

It will be understood that the device 510 is oriented somewhat similarly to that shown in FIG. 7 in both straightening and curling modes. In the straightening mode the length of hair is manipulated so that it passes between the panels 544,546 before passing adjacent to the rotatable element. The panels provide a relatively fixed surface and allow the rotatable element 526 to wind the length of hair around the protrusion 520.

In the curling mode the panels are bypassed and instead the user manipulates the length of hair so that it passes underneath the panel 544 before passing adjacent to the rotatable element.

It will be seen from FIG. 8 that whilst the first panel 544 largely overlies the chamber 516 there is a gap 72 between the chamber wall 62 and the underside of the first panel 544. This gap is required to permit the length of hair to bypass the panels 544, 546, i.e. to pass underneath the panel 544 in the curling mode. Though not shown in the drawings, the secondary opening 70 will preferably have a movable abutment similar to that described in WO2012/080751 which provides a relatively fixed surface and it is the relative rotation between the rotatable element 526 and the movable abutment which causes the proximal portion of the length of hair to be drawn into the device 510 when the panels have been bypassed.

At the end of the styling operation the movable abutment is retracted, allowing the formed curl to be removed from the device 510 around the free end of the protrusion 520.

Another difference between the straightening and curling modes of operation is that the user may wish to grasp a (roughly circular) bunched section of hair if the length hair is to be curled, or to grasp a thin wide section of hair if the length of hair is to be straightened.

In an alternative method of operation, the length of hair 524 is initially placed between the panels 544,546 for both the straightening and curling modes of operation. In the curling mode, the helical element 66 is rotated sufficiently to drive the length of hair (to the right as drawn in FIG. 7) sufficiently far so that it leaves the passage between the panels 544, 546. It will be understood that when the curl has been formed the length of hair may be slid off the end of the protrusion 520 as described above. Such a method of operation might be appropriate if it is expected that users could not reliably manipulate the length of hair into the gap 72 and then adjacent to the rotatable element.

It will be observed from FIG. 7 that the longitudinal axis of the protrusion 520 is at an acute angle α to the edge 68 of the first panel 544 (In this embodiment the angle α is approximately 45°). The handle 514 of the device is aligned substantially parallel with edge 68. In alternative embodiments, the handle may be aligned substantially perpendicular to the edge 68, or substantially parallel to the protrusion, or at some intermediate angle, as desired. In practice, it is expected to be more intuitive for the user to orient the device correctly if the handle is substantially parallel with the edge 68, the user aligning the device with the handle substantially parallel with her scalp. It will therefore be understood that the alignment of the protrusion 520, and the alignment of the rotatable element 526, are somewhat irrelevant to the user, provided that she inserts the hair into (or adjacent to) the path of rotation of the rotatable element.

Whilst in FIG. 7 the axis of rotation of the rotatable element 526 is parallel with, and coincident with, the longitudinal axis of the protrusion 520, that is not necessarily the case, and it will be understood that the rotatable element could wind the length of hair around the elongate member even if those components were oriented at an acute angle relative to one another. It may, for example, be desirable to re-orient the rotatable element clockwise from the orientation shown in FIG. 7, so that it is further out of alignment with the length of hair 524. The ideal situation is that shown in FIG. 1, with the length of hair inserted substantially parallel to the axis of rotation of the rotatable element as that will provide the largest target for the user to insert the length of hair within or adjacent to the path of movement of the rotatable element. As is clear from FIG. 7, however, a parallel arrangement is not necessary; provided that the length of hair can be positioned within the path of movement PM (see FIG. 8) of the rotatable element (with the assistance of the guide member 64 and other guides as desired) it will be captured thereby.

It will be understood that the chamber 516 etc. does not need to have a circular (or even substantially circular) cross-section in order for the device to operate effectively.

Also, whilst FIG. 6 shows the protrusion increasing in cross-section away from the rotatable element, it would be possible to reduce the cross-section away from the rotatable element, and that might induce the length of hair to spread out along the elongate member as it is being wound therearound.

It has also been discovered that it is advantageous to add a rotatable sleeve to the protrusion. The sleeve can be metallic so as to conduct heat in the event that the protrusion is heated. A rotatable sleeve has been found to reduce the tension upon the length of hair as this is passed between the first and second panels. Thus, whilst some tension upon the length of hair is desirable during a straightening operation, providing a rotatable sleeve (and ideally a freely-rotatable sleeve) reduces the likelihood of the length of hair becoming too tightly wound around the protrusion as it is being pulled therefrom.

As above stated, it is desirable that the device 510 has a number of predetermined closure positions for the second panel 546 relative to the first panel 544, i.e. a predetermined series of spacings between the closed panels are available. The user can choose the selected spacing according to the degree of hair straightening required, it being understood that a smaller (e.g. substantially zero) spacing can be used for maximum straightening, whereas a larger spacing (e.g. around 5 millimeters) can be used for partial straightening (smoothing or taming). The second panel 546 is preferably adjustable so that the spacing can be varied across the panels (i.e. it may be desirable to have a variable spacing from side to side and/or from front to back). Such adjustment will be beneficial in ensuring that the panels can be parallel whatever the chosen spacing between them (and can be used to make the panels non-parallel if that is desired).

Also, the first and second panels do not need to be planar, but could be concave or convex as desired to influence the styling operation.

FIG. 9 shows a part of an alternative embodiment of the device, including in particular more detail of the guide member 64. The guide member 64 is carried by the second panel 646 (and similarly by the second panel 546 in the embodiment of FIGS. 7, 8 and 10), and is therefore movable relative to the first panel 644 (544). The guide member 64 is designed to limit the insertion of the length of hair 524 as described above. The guide member 64 is configured as a tapering finger which lies alongside the rotatable element 526, and also acts to press the length of hair 524 into the path of the rotatable element 526 as the device is closed. The guide member 64 passes through a slot in the first panel 544, ensuring that any hair lying alongside the guide member will be located between the panels 544, 546 when the device is closed. The tapering form of the guide member 64 provides the maximum space to insert the length of hair 524 when the device is open, but acts to push the length of hair towards the rotatable element 526 as the device is closed. It is arranged that the guide member 64 is longer than the maximum separation between the panels 544, 546, so that it is not possible for any of the length of hair to pass around or beyond the guide member 64, even when the device is fully open. Whilst only one guide member 64 is shown in the drawings, it will be understood that additional guide members can be provided, in front of and/or behind the rotatable element as desired, in order to assist the user in correctly positioning the length of hair 524 so that it will all be captured by the rotatable element when the rotatable element begins to rotate.

It will be understood that the guide member can alternatively be curved rather than tapered; in either case the shape of the edge of the guide member which engages the length of hair can be identically-formed.

The rotatable element may be rotated in either direction. Because of the misalignment between the axis of rotation of the rotatable element and the inserted length of hair, the direction of rotation of the rotatable element will likely cause the length of hair to be wound slightly differently upon the protrusion, in addition to altering the direction of the curl which is formed into the length of hair.

Figure 11:
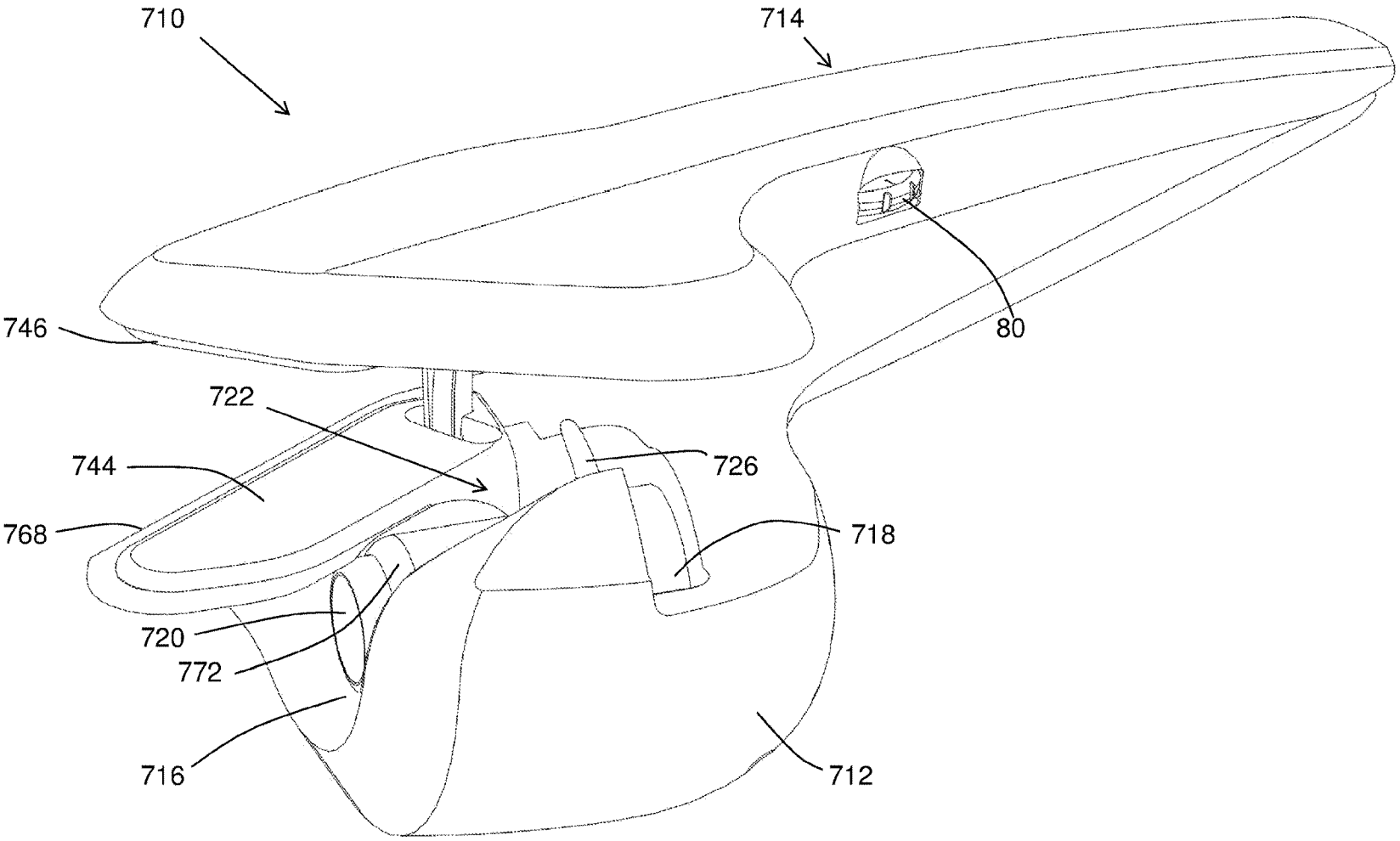
FIG. 11 shows a perspective view of a seventh embodiment of the invention according to the first aspect.

FIG. 11 shows a part of an alternative design of hair styling device, which shares several of the features of the earlier embodiments. In particular, the hair styling device 710 has a body 712 and a two-part handle 714. Within the body 712 is a front chamber 716 and a rear chamber 718. A protrusion 720 is located within the front chamber 716. The body 712 has an opening 722 through which a length of hair 724 (not shown in FIG. 11 but see FIGS. 12 and 13) may pass into the chamber 716 by the rotatable element 726. The device 710 also has a pair of hair-straightening panels 744 and 746.

The handle 714 carries a manually-adjustable dial 80 which can be moved to adjust the spacing between the panels 744 and 746. Thus, it will be understood that the handle parts may be brought together from the position shown in FIG. 11 so that the panels 744, 746 are moved towards one another. The spacing between the panels when the handles are fully closed (which may vary from zero to 5 mm for example) is determined by the position of the dial 80.

The device 710 is suitable for use in a hair straightening mode or in a hair curling mode, as desired. Thus, the protrusion 720 is in the form of an elongate member which has been found suitable for the formation of curls, the protrusion has a free end surrounded by a secondary opening 770 through which a formed curl can be removed from the chamber 716 without deformation, and the device 710 has a gap 772 permitting the length of hair to bypass the panels 744, 746.

Figure 13:
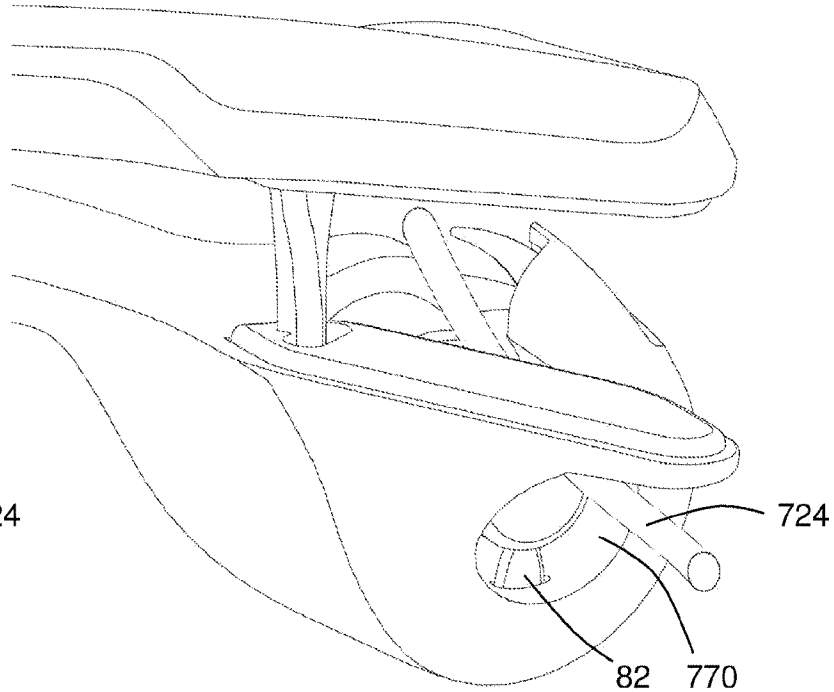
FIG. 13 shows a view as FIG. 12 in a second mode of operation.
Figure 12:
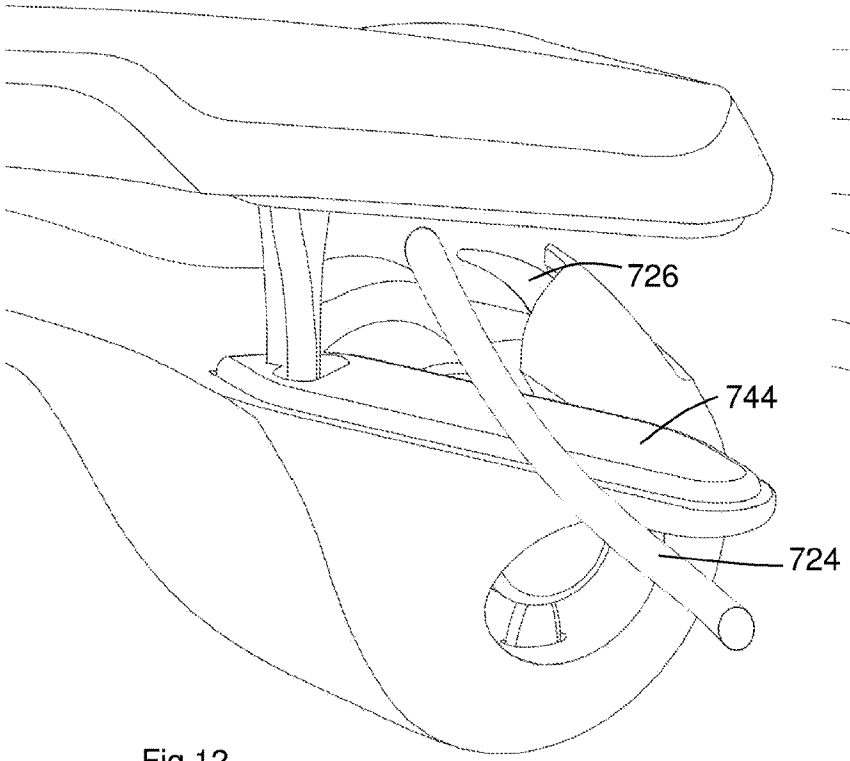
FIG. 12 shows a perspective view of part of the hair styling device of FIG. 11 in a first mode of operation.

The two modes of operation are represented in FIGS. 12 and 13. In both modes of operation the device is held with the edge 768 of the panel 744 close to the user's head, and with the free end of the protrusion 720 directed towards the user's head. In the hair straightening mode of FIG. 12, the user manipulates the length of hair 724 so that it passes between the panels 744, 746 and across the path of the rotatable element 726, as described in relation to the earlier embodiments. The panels are brought together so that the length of hair is pressed to a position within the path of movement of the rotatable element 726 (if it was not already in such a position) and the rotatable element 726 is covered to prevent engagement with extraneous hair. The rotatable element rotates to wind the length of hair around the protrusion 720. The length of hair is then removed from the chamber 716, passing between the panels 744,746 and being fully or partially straightened thereby. FIG. 12 does not show a distributing component, although a component such as that shown in FIG. 8 or FIG. 9 for example could be mounted adjacent to or within the panel 746.

In the curling mode of FIG. 13, the user manipulates the length of hair so that it passes underneath the panel 744 as drawn and through the gap 772. The device is then operated in the same way as described above, but at the end of the styling operation the formed curl is slid off the end of the protrusion 720 through the secondary opening 770 so as to retain the formed curl. FIG. 13 shows a movable abutment 82 within the secondary opening 770 which acts as a fixed stop to ensure that the length of hair is wound around the protrusion 720; the movable abutment 82 can be moved out of the secondary opening 770 to allow the length of hair to slide off the end of the protrusion 720.

FIG. 12 shows the length of hair 724 in a bunched form, whereas as explained above a user seeking to use the device in the straightening mode would typically collect a more ribbon-like length of hair.

Figure 16:
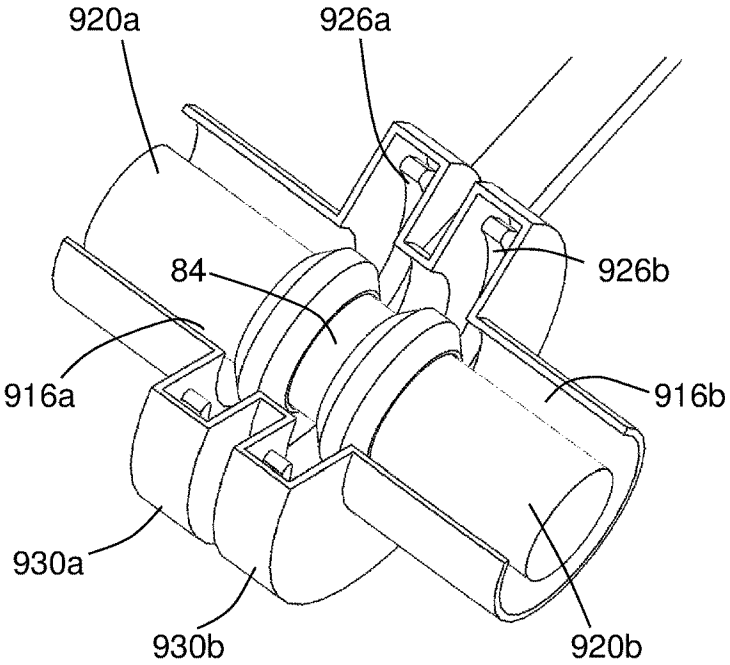
FIG. 16 shows a perspective view of part of a ninth embodiment of hair styling device, according to the third and fourth aspects of the invention.
Figure 15:
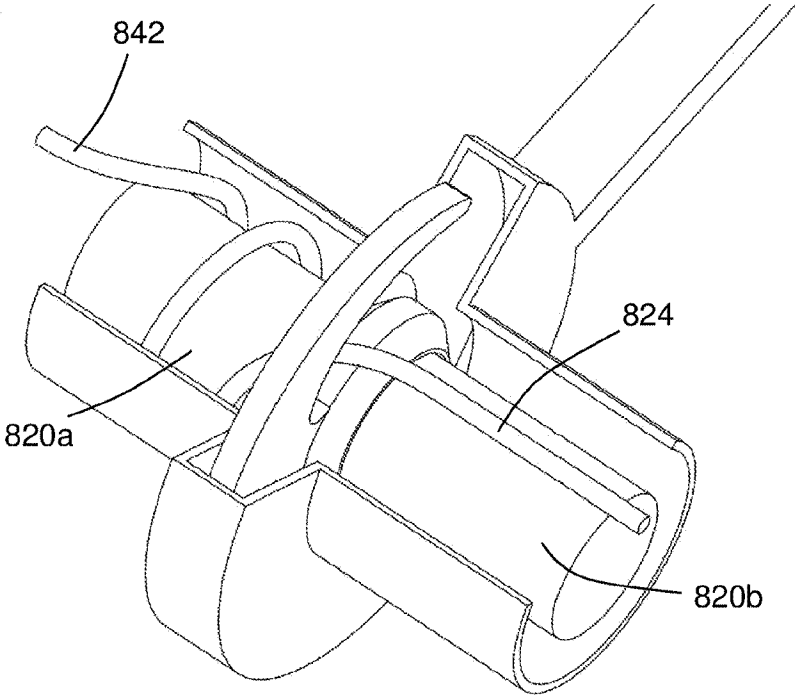
FIGS. 14 and 15 show a perspective view of part of an eighth embodiment of hair styling device, according to the third aspect of the invention.
Figure 14:
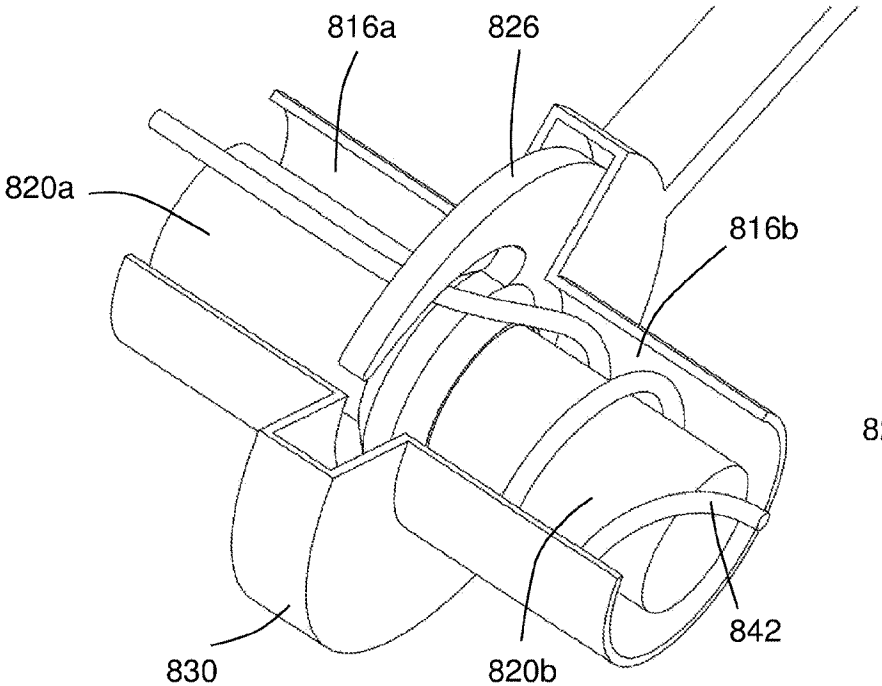

FIGS. 14-16 show a part of an alternative hair styling device, according to the second aspect of the invention. According to this aspect the hair styling device has two chambers 816*a*, 816*b* and two protrusions 820*a*, 820*b*. The rotatable element 826 lies between the two chambers. In this embodiment the device is symmetrical in that the chambers 816*a,b* and the protrusions 820*a,b* are each identically formed, but that is not necessarily the case. In alternative embodiments the cross-sectional dimension (diameter) of the chamber 816*a* differs from that of the chamber 816*b* so that the chambers will form differently-sized curls. In other alternative embodiments the cross-sectional dimension (diameter) of the protrusions differs. In yet other alternative embodiments the length of the chambers and/or the length of the protrusions may differ.

As with all embodiments of the device, it can be arranged that the protrusions 810*a,b* rotate together with the rotatable element 826, or are fixed relative to the body of the device, or carry a freely-rotatable sleeve which can rotate under a force applied by the length of hair when wound therearound.

It will be understood that each of the chambers 816*a,b* can act as the styling chamber, depending upon the orientation of the device 810 relative to the user's head. As will be understood from the disclosures of the identified prior art documents, the rotating rotatable element 826 initially causes the length of hair 824 to be drawn into both of the chambers 816,*a,b*. However, since the proximal end 842 of the length of hair 824 is attached to the user's scalp, the length of hair will subsequently be drawn into the chamber which is closest to the user's head. In the orientation of FIG. 14 the end 842 is at the near end as drawn, whilst in FIG. 15 the end 842 is at the far end as drawn. The distal end of the length of hair 824 is shown as straight in the drawings so as to clearly distinguish between the proximal and distal ends, whereas in practice it will be wound around the (distal) protrusion.

Though not shown in these figures, there is preferably a respective movable abutment within the secondary opening surrounding the free end of each of the protrusions 820*a,b*.

Since both of the protrusions 820*a,b* are mounted in cantilever, it will be understood that they are connected to the body adjacent to the rotatable element 826. Suitably, a rigid bridge (not seen) is connected to both of the protrusions, with a connection to drive the rotatable element 826 therebetween. Alternatively, the protrusions 820*a,b* are rigidly connected together and are connected to the body to one side of the rotatable element. In one embodiment, the rotatable element 826 is driven to rotate by way of its periphery, specifically by engagement with a number of drive wheels and/or gears within the channel member 830.

The arrangement of FIGS. 14-15 is suitable for curling a length of hair in each of the chambers 816*a,b*, and is therefore ideally suited to forming curls of differing dimensions (as well as avoiding the requirement for the user to orient the device correctly). However, a modified device could utilise one of the chambers to form curls in a length of hair, and the other chamber as a collection (and perhaps pre-heating) chamber for the subsequent straightening of a length of hair. Thus, a set of panels such as those of FIGS. 1-3 for example could be located adjacent to one of the chambers 816*a* or 816*b*. The user could then orient the device with the hair-straightening panels towards her head for a straightening operation, or with the hair-straightening panels away from her head for a curling operation. Such a device could have an appearance similar to that of FIG. 1, but with the shaft (52) having a free end, i.e. the closed far end of the device of FIG. 1 replaced by a secondary opening surrounding the shaft. The shaft could then act as the protrusion around which the length of hair is curled when the device is operated in the curling mode.

It will also be understood that since the protrusion around which the length of hair is wound for the hair-straightening mode does not need a free end from which the formed curl is removed, the protrusion (and rotatable element) could be mounted (and rotated) at its end (i.e. at the near end as drawn in FIG. 1).

The alternative embodiment of FIG. 16 has two rotatable elements 926*a* and 926*b*, each located in its own channel 930*a,b* respectively. Whilst the embodiment shown has two (identical) chambers 916*a,b* and two (identical) protrusions 920*a,b*, it will be understood that two rotatable elements could be used with all of the disclosed embodiments (and also with all of the arrangements of the identified prior art documents).

A shaft 84 lies between the rotatable elements 926*a* and 926*b*, which shaft is rigidly connected to the body of the device by a suitable beam or mounting (not seen). The shaft is in turn connected to the protrusions 920*a,b* to hold the protrusions in place. The shaft is also connected to the rotatable elements 926*a,b* and has drive elements for driving each of the rotatable elements to rotate.

The rotatable elements 926*a,b* can be rotated independently, i.e. they can be driven to rotate in the same direction, ideally in synchrony, or relative to one another as desired. In one mode of operation the rotatable elements are driven to counter-rotate, which will have the effect of drawing the length of hair more quickly into the device. The rotatable elements can rotate at the same rate but in opposite directions, or at different rates, as desired.

In an alternative mode of operation, one of the rotatable elements is driven to rotate and the other is held stationary. It is expected that in such embodiments there will be less tension upon the length of hair if the rotatable element which is closest to the user's scalp is rotated and the rotatable element farthest from the scalp is held stationary. If the mode of operation determines the required orientation of the device the setting of the mode of operation by the user can also determine which of the rotatable elements will rotate. Alternatively, the device can include sensors to detect the proximity of the user's head at each side of the device in order automatically to rotate the proximal rotatable element.

Figure 17:
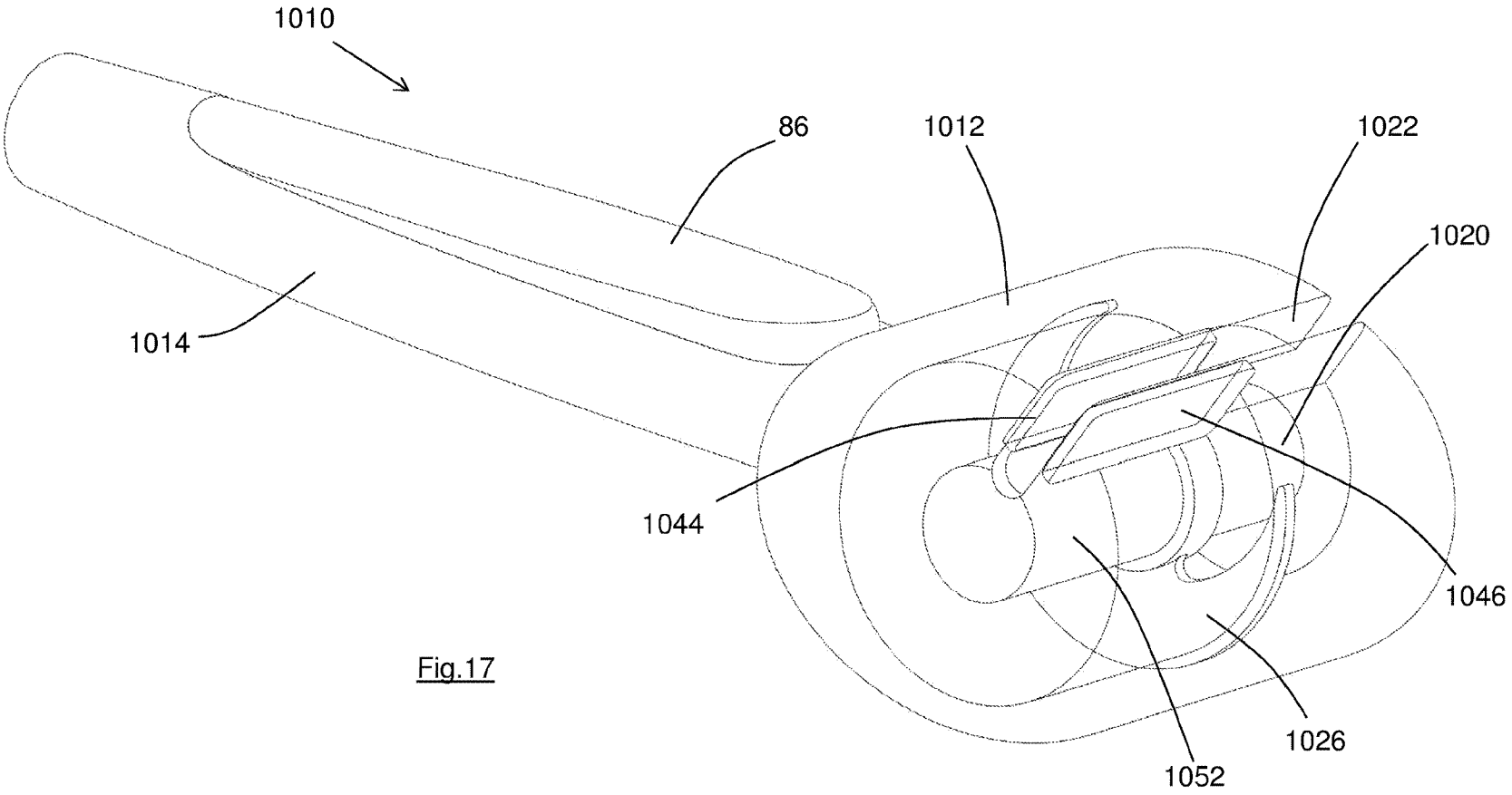
FIG. 17 shows a perspective view of a tenth embodiment of hair styling device, according to the first aspect of the invention.

FIG. 17 shows a tenth embodiment of hair styling device 1010 having a body 1012 and a handle 1014. The handle 1014 is not a two-part handle such as that shown in earlier embodiments, although the control button 86 does move relative to the remainder of the handle.

FIG. 17 represents the body 1012 as partially transparent for ease of understanding, and in particular shows the first hair-straightening panel 1044, the second hair-straightening panel 1046, the rotatable element 1026, the shaft 1052 and the protrusion 1020 which would in practice not be visible (or not fully visible) through the solid wall of the body 1012.

The opening 1022 through which the length of hair (not shown) enters the chamber within the body 1012 is a slot which is permanently open. Thus, unlike the other embodiments there is no cover for the opening 1022 and extra care must be taken by the user in order to ensure firstly that the length of hair is pressed sufficiently far into the slot 1022 to lie within the path of movement of the rotatable element 1026. Secondly, extra care must be taken to ensure that stray hair does not inadvertently enter the slot and engage the rotatable element whilst it is rotating.

The hair-straightening panels 1044, 1046 lie to opposing sides of the slot 1022 and in the position shown are separated so as not to obscure any part of the slot and hinder the insertion of the length of hair. It will be seen that the body 1012 has a closed (near) end at the end of the shaft 1052, and an open (far) end surrounding the free end of the protrusion 1020, similar to the embodiment of FIGS. 11-13. A movable abutment (not seen) is located at the free end of the protrusion 1020.

When it is desired to use the device in hair-straightening mode, the device 1010 is oriented with the shaft 1052 towards the user's scalp. The user depresses the control button 86 to actuate the rotatable element 1026 and draw the length of hair (ultimately) into the chamber around the shaft 1052. The device is manipulated until the proximal end of the length of hair lies between the panels 1044, 1046 and the panels are then moved together to their desired separation whereupon the length of hair can be pulled from the chamber through the passage between the panels.

Because in this embodiment the panels are not carried by, nor moved by, the handle, other means are provided to move the panels 1044, 1046, ideally one or more dedicated motors. The panels may move to the hair-straightening position (having the desired separation) upon actuation by the user, or at a predetermined time interval after commencement of rotation of the rotatable element 1026.

In the hair-curling mode, the device 1010 is oriented with the free end of the protrusion 1020 towards the user's scalp, as explained in relation to earlier embodiments.

It will be observed that the handle 1014 is oriented substantially perpendicular to the longitudinal axis of the slot 1022, but the relative orientation of the handle and slot is unimportant in this embodiment as in the other embodiments. Also, whilst the slot 1022 is shown oriented at an approximate "1 o'clock" position in FIG. 17, that orientation is also unimportant and it is expected that most users will be able to manipulate the device to orient the slot correctly, substantially regardless of the orientation of the slot.

The invention claimed is:

1. A hair styling device having:

a body defining a chamber adapted to accommodate a length of hair, the chamber having an opening through which the length of hair may pass into the chamber;

a rotatable element adapted to engage the length of hair adjacent to the opening;

a protrusion around which, in use, the length of hair is wound by the rotatable element; and a first hair-straightening panel and a second hair-straightening panel, the first hair-straightening panel and the second hair-straightening panel facing one another and being movable relative to one another;

the device having a number of user-selectable settings providing a number of different predetermined spacings between the hair-straightening panels.

2. The hair styling device according to claim 1 having a heating element for at least one of the first and second hair-straightening panels.

3. The hair styling device according to claim 2 in which there is at least one first heating element for the first hair-straightening panel, at least one second heating element for the second hair-straightening panel, and at least one third heating element for the chamber.

4. The hair styling device according to claim 3 in which the third heating element(s) operate at a higher temperature than the first and second heating element(s).

5. The hair styling device according to claim 1 in which the device has multiple heating elements.

6. The hair styling device according to claim 1 in which the protrusion has a free end and the device has a secondary opening adjacent to the free end.

7. The hair styling device according to claim 1 in which the first and second hair-straightening panels are substantially planar.

8. The hair styling device according to claim 1 having a distributing component adapted in use to engage the length of hair and separate the length of hair into separate portions.

9. The hair styling device according to claim 8 in which the distributing component is movable relative to the first and second hair-straightening panels and is adapted to move the length of hair relative to the panels.

10. The hair styling device according to claim 8 in which the distributing component is in the form of a helical element having a longitudinal axis, the helical element being rotatable about its longitudinal axis (L-L).

11. The hair styling device according to claim 8 in which a peripheral edge of the distributing component is deformable.

12. The hair styling device according to claim 1 in which the first hair-straightening panel has a leading edge and a trailing edge, the leading edge being closer to the rotatable element than the trailing edge, the trailing edge being substantially linear, the rotatable element rotating about a rotation axis, the rotation axis being at an acute angle ($\alpha$) to the trailing edge.

13. The hair styling device according to claim 12 in which the protrusion has a longitudinal axis, the longitudinal axis of the protrusion being at an acute angle to the trailing edge.

14. The hair styling device according to claim 1 in which one of the first and second hair-straightening panels carries a guide part, and the other of the first and second hair-straightening panels has a guide part opening through which the guide part can pass.

15. The hair styling device according to claim 14 in which the guide part has a curved hair-engagement surface and in use acts both to guide the length of hair towards the rotatable element, and also to press the length of hair towards the opening of the chamber.

16. A method of styling hair comprising the following steps:

{i} providing a hair styling device having:

a body defining a chamber, the chamber having an opening;

a rotatable element located adjacent to the opening;

a protrusion within the chamber; and a first hair-straightening panel and a second hair-straightening panel, the first hair-straightening panel and the second hair-straightening panel facing one another and being movable relative to one another;

the device having a number of user-selectable settings providing a number of different predetermined spacings between the hair-straightening panels;

{ii} selecting a chosen spacing between the panels;

{iii} collecting a length of hair to be styled;

{iv} positioning the length of hair adjacent to the opening and within the path of movement of the rotatable element;

{v} rotating the rotatable element, the rotatable element engaging the length of hair and winding the length of hair around the protrusion;

{vi} removing the length of hair from the chamber through a passage between the hair-straightening panels, the length of hair being styled as it passes between the panels.

17. The method according to claim 16 in which the step {ii} is undertaken before step {iii}.

* * * * *